US005801660A

United States Patent [19]

Ohtsuka et al.

[11] Patent Number: 5,801,660

[45] Date of Patent: *Sep. 1, 1998

[54] ANTENNA APPARATUUS USING A SHORT PATCH ANTENNA

[75] Inventors: Masataka Ohtsuka; Yoji Isota; Shintaro Nakahara; Makoto Matsunaga; Yoshihiko Konishi, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 595,034

[22] Filed: Jan. 31, 1996

[30] Foreign Application Priority Data

Feb. 14, 1995 [JP] Japan ..... 7-025129

[51] Int. Cl.[6] ..... H01Q 1/38

[52] U.S. Cl. ..... 343/700 MS; 343/846

[58] Field of Search ..... 343/700 MS, 846, 343/702, 741, 851; 333/24 C, 246

[56] References Cited

U.S. PATENT DOCUMENTS

| | | | |
|---|---|---|---|
| 4,040,060 | 8/1977 | Kaloi | 343/846 |
| 4,170,013 | 10/1979 | Black | 343/700 MS |
| 4,749,996 | 6/1988 | Tresselt | 343/700 MS |
| 4,929,959 | 5/1990 | Sorbello et al. | 343/700 MS |
| 5,027,130 | 6/1991 | Akaba et al. | 343/872 |
| 5,043,738 | 8/1991 | Shapiro et al. | 343/700 MS |
| 5,165,109 | 11/1992 | Han et al. | 343/700 MS |
| 5,355,143 | 10/1994 | Zürcher et al. | 343/700 MS |
| 5,396,202 | 3/1995 | Scheck | 343/700 MS |
| 5,448,250 | 9/1995 | Day | 343/700 MS |
| 5,510,803 | 4/1996 | Ishizaka et al. | 343/700 MS |
| 5,532,643 | 7/1996 | Kuffner et al. | 343/700 MS |

FOREIGN PATENT DOCUMENTS

| | | |
|---|---|---|
| 555820 | 3/1993 | Japan . |
| 5145327 | 6/1993 | Japan . |

*Primary Examiner*—Donald T. Hajec
*Assistant Examiner*—Tan Ho
*Attorney, Agent, or Firm*—Rothwell, Figg, Ernst & Kurz

[57] ABSTRACT

A planar antenna apparatus adapted to excite a small radiating element by electromagnetic coupling is provided. The antenna apparatus has a triplate line including ground conductor plates formed on the upper and lower surfaces of a dielectric substrate and a feed line sandwiched by the ground conductor plates. A coupling hole is formed through one of the ground conductor plates, and a mechanism is provided near the coupling hole for electrically interconnecting the two ground conductor plates. A radiating section coupled to the feed line through the coupling hole has one end grounded to form a short patch antenna. The short patch antenna has a size substantially half the size of a patch antenna. Also, the connecting mechanism prevents unnecessary coupling.

22 Claims, 18 Drawing Sheets

ANTENNA APPARATUUS USING A SHORT PATCH ANTENNA

BACKGROUND OF THE INVENTION

1. Field of the Invention

The present invention relates to a flat antenna apparatus having a single radiating element or a plurality thereof.

2. Description of the Related Art

FIGS. 1*a*~1*c* are diagrams for explaining the structure of a prior art antenna apparatus shown in Laid-open Japanese Patent Application No. 5-145327. This antenna apparatus is used, for example, for an automobile telephone utilizing artificial satellites or the like and is composed of two dielectric substrates. In these drawings, FIG. 1*b* shows the upper one of the two dielectric substrates, and FIG. 1*c* the lower one, respectively. These dielectric substrates are stacked to form the antenna apparatus shown in FIG. 1*a*.

Referring more specifically to FIGS. 1*a*~1*c*, the antenna apparatus includes a first dielectric substrate 1 in the form of a thin plate; a second similar dielectric substrate 2; a radiating element 3 formed on the upper surface of the first dielectric substrate 1; a strip conductor 4 formed on the lower surface of the second dielectric substrate 2; a ground conductor plate 5 formed over the entire surface of the second dielectric substrate 2 and which constitutes a microstrip line together with the strip conductor 4; and a patch 6 arranged on the ground conductor plate 5 formed on the surface of the second dielectric substrate 2 and having a length shorter than a transmission wavelength. The patch 6 and the ground conductor plate 5 are insulated from each other by a non-conductive area 7. Also, a feed pin 8 connects the patch 6 to the strip line 4.

In the antenna apparatus shown in FIG. 1*a*, the ground conductor plate 5 and the patch 6 are sandwiched between the first dielectric substrate 1 and the second dielectric substrate 2 and therefore are not visible from the outside. On the other hand, the radiating element 3 appears on the upper surface of the antenna apparatus, while the strip line 4 appears on the lower surface of the antenna apparatus.

Next, the operation of the above-mentioned antenna apparatus will be described. Referring again to FIG. 1*a*, a signal passing through the strip line 4 excites the patch 6 via the feed pin 8. Since the patch 6 is electromagnetically coupled to the radiating element 3, the excited patch 6 causes the radiating element 3 to also excite. In this way, a radio wave is radiated in the air.

In the prior art antenna apparatus shown in FIG. 1*a*, since the patch 6 and the radiating element 3 are electromagnetically coupled to each other, no feed pin is required for connecting the radiating element 3 to the strip line 4, thus enabling simplification of the power supply structure.

However, because of the size of the radiating element 3 extending approximately $\lambda g/2$ ($\lambda g$ represents a wavelength in the dielectric substrate) it may be disadvantageous when a plurality of such antenna apparatuses are used to configure an array antenna.

Also, this type of antenna apparatus employs dielectric substrates which present fewer losses in a high frequency range, in order to improve efficiency. However, such substrates are generally expensive, thereby resulting in increased manufacturing costs. Further, since the dielectric substrates are used, the antenna apparatus inevitably suffers from some dielectric loss.

SUMMARY OF THE INVENTION

The present invention has been made to solve the problems mentioned above, and it is an object of the invention to provide an antenna apparatus which has a smaller radiating element as compared with prior art antenna apparatuses.

It is another object of the present invention to provide an antenna apparatus which can be manufactured at lower cost.

It is a further object of the present invention to provide an antenna apparatus which presents less dielectric loss.

It is a further object of the present invention to provide a structurally stable antenna apparatus.

It is yet a further object of the present invention to provide an antenna apparatus which is capable of easily matching a transmission line with a radiating element over a wide frequency band.

It is another object of the present invention to provide an antenna apparatus which is capable of reducing adverse influences due to unnecessary scattering waves resulting from environmental factors around the antenna apparatus.

To achieve the above objects, the present invention provides an antenna apparatus comprising:

- a ground conductor plate;
- a radiating element of a short patch antenna type arranged on the ground conductor plate;
- a feed circuit for exciting the radiating element; and
- a coupling hole formed on the ground conductor plate for electromagnetically coupling the feed circuit to the radiating element.

In one embodiment of the present invention, the ground conductor plate is formed on one surface of a dielectric substrate, and the radiating element includes a signal radiating section formed on the other surface of the dielectric substrate and connecting means for connecting the signal radiating section to the ground conductor plate.

The feed circuit is a triplate line including the ground conductor plate, another ground conductor plate and a strip conductor sandwiched between these ground conductor plates, or a microstrip line including the ground conductor plate and a strip conductor spaced apart from the ground conductor plate.

In another embodiment of the present invention, the ground conductor plate is formed on a dielectric substrate, and the radiating element may include a signal radiating section spaced by a predetermined distance from the ground conductor plate and connecting means for connecting one end of the signal radiating section to the ground conductor plate.

The radiating element is spaced apart from the ground conductor plate by a predetermined distance, and a space is provided between the radiating element and the ground conductor plate.

Preferably, the dielectric substrate is a foam dielectric substrate.

The ground conductor plate may be formed by plating the dielectric substrate.

The antenna apparatus may further comprise a holding member for holding a constant spacing between the signal radiating section of the radiating element and the ground conductor plate.

The radiating element may be arranged such that a positional relationship thereof with the coupling hole is adjustable.

The antenna apparatus may further comprise another ground conductor plate in addition to and spaced apart from the ground conductor plate, wherein a feed conductor is arranged between the two ground conductor plates, and a connecting mechanism for connecting the ground conductor plate to the other conductor plate near the coupling hole may be provided near the coupling hole.

The connecting mechanism may be a conductor block arranged between the ground conductor plate and the other ground around conductor plate for connecting the two ground conductor plates and for electrically shielding the feed conductor.

Preferably, the feed conductor includes a low impedance portion or a stub near the coupling hole to enhance electromagnetic coupling between the radiating element and the feed circuit.

The spacing between the radiating element and the ground conductor plate may be made different at a grounded end and an open end of the radiating element.

The radiating element may be composed of a plurality of radiating elements having respective signal radiating sections spaced from each other by a predetermined distance.

The present invention also provides an antenna apparatus comprising:

(1) an antenna section including:

a feed circuit for transmitting signals;

a ground conductor plate formed with at least one coupling hole;

at least one radiating section excited by the feed circuit through the coupling hole; and grounding means for grounding an end of the radiating section to the ground conductor plate;

(2) a housing for accommodating the antenna section; and (3) scattered wave reducing means arranged around the housing.

The scattered wave reducing means may be either one of a conductor block having a tapered portion, the height of which is gradually decreased from the top end of the housing to a base portion of the housing, a wave absorbing member arranged on the top end of the housing and means for electrically short-circuiting between the housing and the ground conductor plate.

The present invention further provides an antenna apparatus comprising:

(1) an antenna section including:

a feed circuit for transmitting signals;

a ground conductor plate formed with at least one coupling hole;

at least one radiating section excited by the feed circuit through the coupling hole; and grounding means for grounding an end of the radiating section to the ground conductor plate;

(2) a housing for accommodating the antenna section; and (3) propagation delay means for delaying the phases of waves propagated from the radiating section to control changes in radiation patterns of the antenna section caused by scattered waves generated around the antenna section.

BRIEF DESCRIPTION OF THE DRAWINGS

The above and other objects and advantages of the present invention will become apparent from the following description taken in connection with the accompanying drawings.

DESCRIPTION OF THE PREFERRED EMBODIMENTS

The present invention will hereinafter be described in connection with its embodiments in detail with reference to the accompanying drawings.

Figure 2:
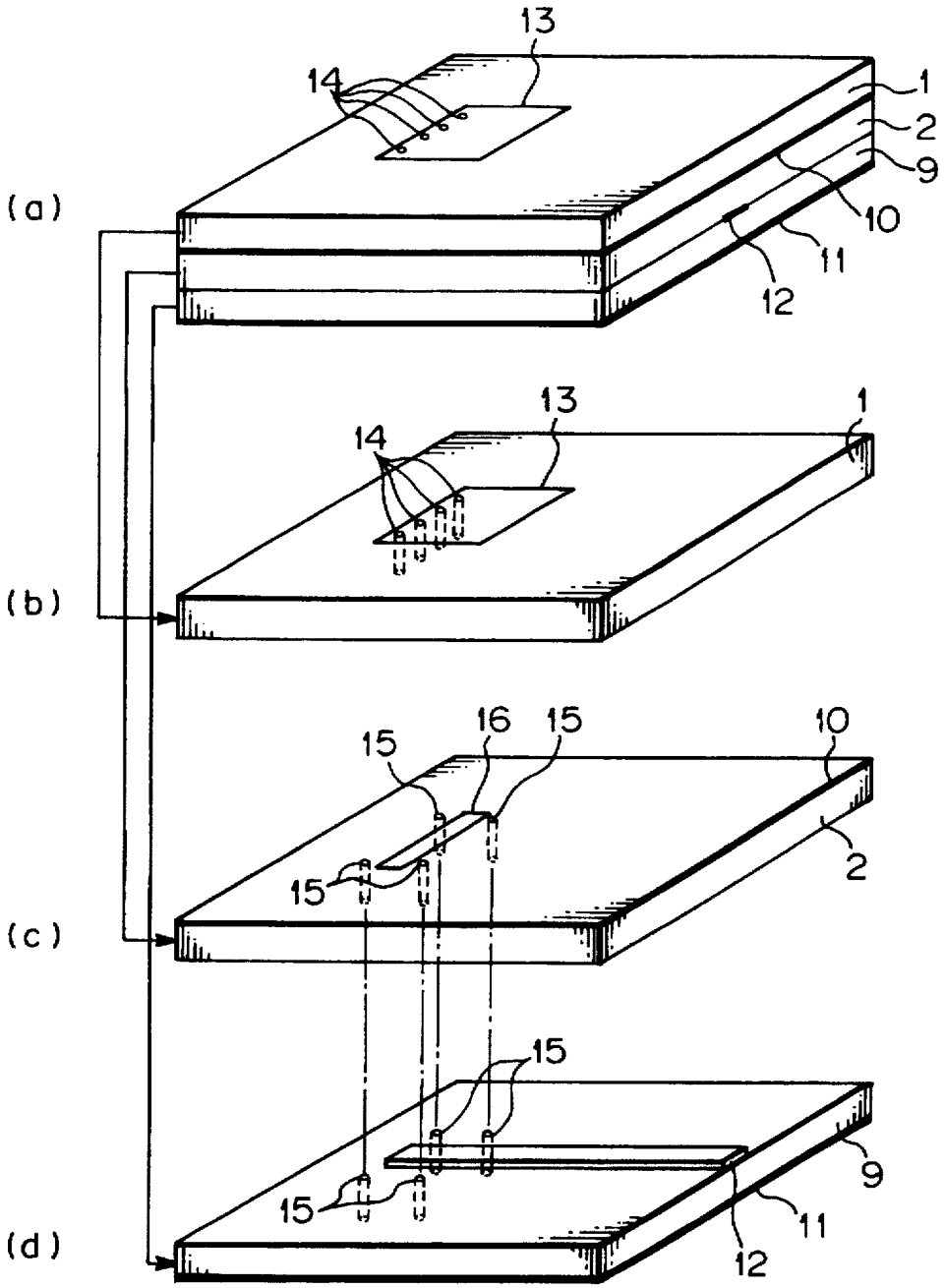
FIG. 2*a* is a perspective view schematically showing the structure of the first embodiment of an antenna apparatus according to the present invention.
FIGS. 2*b*, 2*c* and 2*d* show constituent elements of the antenna apparatus illustrated in FIG. 2*a;*

FIGS. 2*a*~2*d* are diagrams for explaining the structure of a first embodiment of an antenna apparatus according to the present invention. This antenna apparatus is used, for example, for an automobile telephone or the like which utilizes artificial satellites. The antenna apparatus comprises three dielectric substrates. FIG. 2*b* shows the upper one; FIG. 2*c* the intermediate one; and FIG. 2*d* the lower one, respectively. These dielectric substrates are stacked to constitute the antenna apparatus shown in FIG. 2*a*.

Referring specifically to FIGS. 2*a*~2*d*, the antenna apparatus comprises a first flat dielectric substrate 1; a second dielectric substrate 2 similar to the first flat dielectric substrate 1; a third dielectric substrate 9 also similar to first flat dielectric substrate 1; a first ground conductor plate 10 formed over the entire upper surface of the dielectric substrate 2; and a second ground conductor plate 11 formed over the entire lower surface of the dielectric substrate 9; a strip line 12, formed on the upper surface of the dielectric substrate 9 and which constitutes a triplate line together with the first and second ground conductor plates 10, 11; a radiating element 13 arranged on the upper surface of the first dielectric substrate 1; and a short-circuit portion 14 including throughholes formed through the dielectric substrate 1, which throughholes have inner wall surfaces plated to electrically connect one end of the radiating element 13 to the ground conductor plate 10. The short-circuit portion 14 includes a plurality of (four in FIG. 2*b*) throughholes linearly arranged in one end portion of the radiating element 13. A ground conductor plate connecting mechanism 15 includes a plurality (four in FIG. 2) of throughholes extending through the dielectric substrates 2, 9 and having its inner wall plated for electrically connecting the first ground conductor plate 10 to the second ground conductor plate 11. The throughholes constituting the ground conductor plate connecting mechanism 15 are located around a coupling hole 16 (in FIG. 2*c*, near respective corners of the coupling hole 16). The coupling hole 16, formed through the ground conductor plate 10, electromagnetically couples the strip line 12 to the radiating element 13.

In the antenna apparatus shown in FIG. 2*a*, the first ground conductor plate 10 is sandwiched between the first dielectric substrate 1 and the second dielectric substrate 2, while the strip line 12 and the coupling hole 16 are sandwiched between the second dielectric substrate 2 and the third dielectric substrate 9, so that these elements are not visible from the outside. On the contrary, the radiating element 13 appears on the upper surface of the antenna apparatus, and the second ground conductor plate 11 appears on the lower surface of the same.

Next, the operation of the antenna apparatus shown in FIG. 2*a* will be described. In FIG. 2*a*, a signal passing through the strip line 12 excites the radiating element 13 through the coupling hole 16. The excited radiating element 13 radiates the signal in the air. In this event, a parallel plate mode signal propagating between the ground conductor plates 10 and 11 is generated near the coupling hole 16.

Since the ground conductor plate connecting mechanism 15 causes the potential between the ground conductor plates 10 and 11 to be nulled around the coupling hole 16, the parallel plate mode signal is prevented from propagating externally to the ground conductor plate connecting mechanism 15. In this way, the ground conductor plate connecting mechanism 15 can reduce loss and unnecessary coupling with other feed lines due to the parallel plate mode signal generated as mentioned above.

Figure 1:
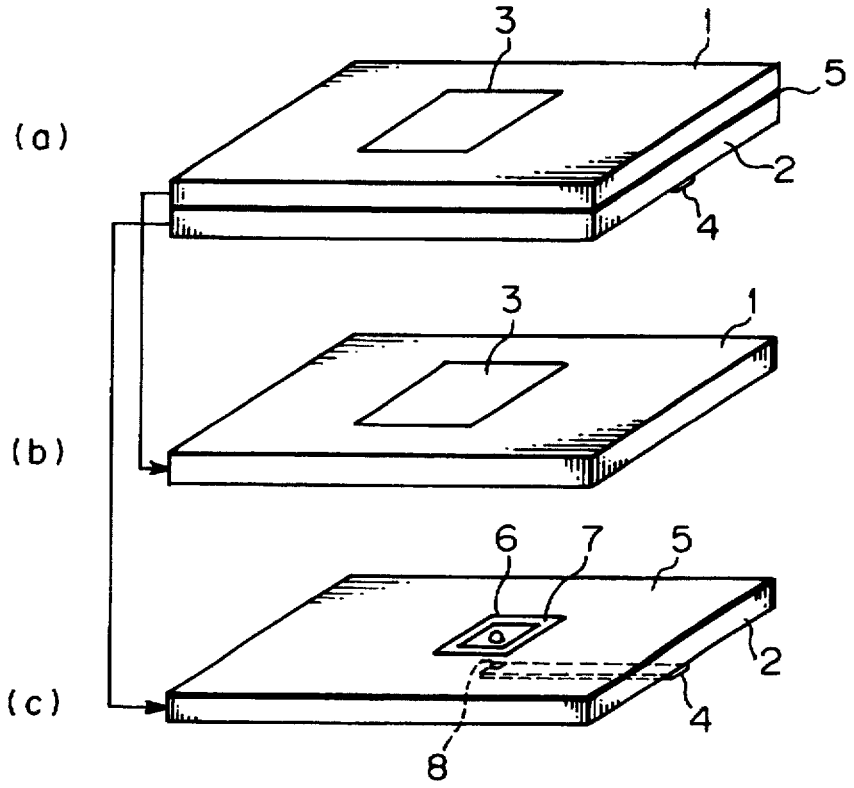
Fig. 1 (PRIOR ART)
FIG. 1*a* is a perspective view schematically showing the structure of a prior art antenna apparatus.
FIGS. 1*b* and 1*c* show constituent elements of the antenna apparatus illustrated in FIG. 1*a;*

The excited radiating element 13 constitutes a so-called short patch antenna. The radiating element 13 has one end connected to the ground conductor plate 10 through the short-circuit portion 14 and the other end left opened. Therefore, the radiating element 13 resonates when the distance between the shorted end and the open end is approximately $\lambda g/4$ ($\lambda g$ is the wavelength within the dielectric material) to obtain a maximum radiation efficiency. The prior art example shown in FIG. 1*a*, on the other hand, does not employ a short patch antenna but a radiating element having both ends opened. With this structure, the distance between the ends of the radiating element must be approximately $\lambda g/2$ in order for the radiating element to resonate. As can be understood from this description, the size of the radiating element 13 employed in the antenna apparatus of the first embodiment is approximately half the size of the radiating element employed in the conventional antenna apparatus. It is therefore possible to reduce the size of the entire antenna apparatus.

As described above, according to the antenna apparatus of the first embodiment, since the radiating element is formed of a short patch antenna in an antenna apparatus including a simple feed structure utilizing the electromagnetic coupling, the antenna apparatus can be manufactured to be of a smaller size.

It should be noted that in the first embodiment, the dielectric substrates 1 and 2 are not necessarily made of the same material or in the same thickness, whereas the dielectric substrates 2 and 9 are preferably made to have the same characteristics in order to maintain a balanced operation of the strip line 12.

While the antenna apparatus of the first embodiment includes a triplate line as a feed line, a microstrip line may be used as an alternative.

FIGS. 3*a*~3*c* show perspective views for explaining the structure of a second embodiment of the antenna apparatus according to the present invention. The antenna apparatus of the second embodiment is mainly composed of two dielectric substrates. FIG. 3*b* shows the upper one of the two dielectric substrates, and FIG. 3*c* the lower one, respectively. These dielectric substrates are stacked to complete the antenna apparatus shown in FIG. 3*a*.

Referring specifically to FIGS. 3*a*~3*c*, a strip line 4 is arranged on the lower surface of a second dielectric substrate 2 for transmitting signals. A ground conductor plate 10 and the strip line 4 form a microstrip line. A first dielectric substrate 1, a second dielectric substrate 2, the first ground conductor plate 10, a radiating element 13, a short-circuit portion 14, and a coupling hole 16 are identical to or corresponding to those used in the first embodiment (FIG. 2*a*).

In the antenna apparatus shown in FIG. 3*a*, the first ground conductor plate 10 and the coupling hole 16 are sandwiched between the first dielectric substrate 1 and the second dielectric substrate 2, so that these elements are not visible from the outside. The radiating element 13, on the other hand, appears on the upper surface of the antenna apparatus, while the strip line 4 appears on the lower surface of the same.

Next, the operation of the antenna apparatus according the second embodiment will be described. A signal propagating through the strip line 4 excites the radiating element 13 through the coupling hole 16 by electromagnetic coupling. The excited radiating element 13 radiates the signal in the air. The distance between both ends of the radiating element 13 is approximately $\lambda g/4$ which is the same as the first embodiment.

As described above, according to the antenna apparatus of the second embodiment, since the radiating element is formed of a short patch antenna in an antenna apparatus including a simple feed structure utilizing electromagnetic coupling, the antenna apparatus can be manufactured to be of a smaller size.

It should be noted that in the second embodiment, the dielectric substrates 1 and 2 are not necessarily made of the same material or in the same thickness.

Figure 4:
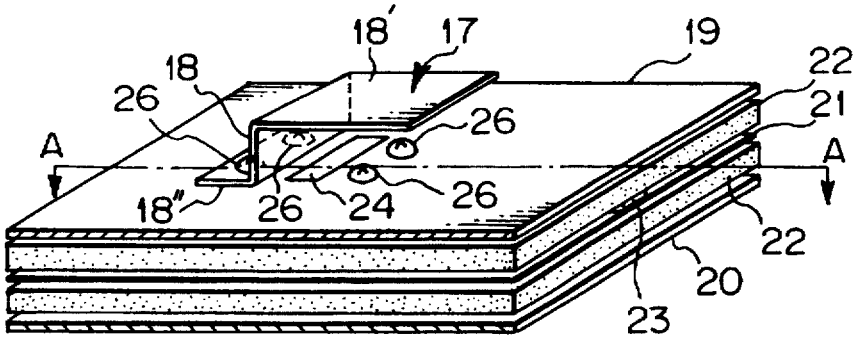
FIG. 4 is a perspective view schematically showing the structure of the third embodiment of an antenna apparatus according to the present invention.
Figure 5:
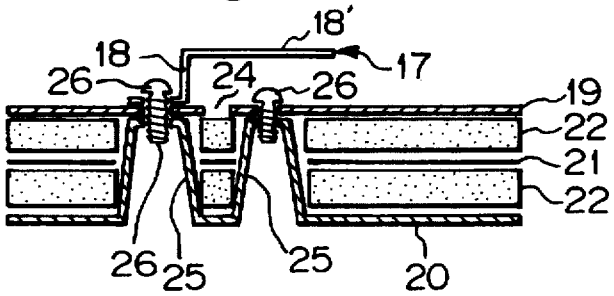
FIG. 5 is a cross-sectional view taken along a line A—A in FIG. 4.

A third embodiment of the antenna apparatus according to the present invention will next be described with reference to FIGS. 4~6. FIG. 4 is a perspective view of an antenna apparatus according to the third embodiment; FIG. 5 a cross-sectional view taken along a line A—A in FIG. 4; and FIG. 6 a top plan view of the antenna apparatus.

Figure 6:
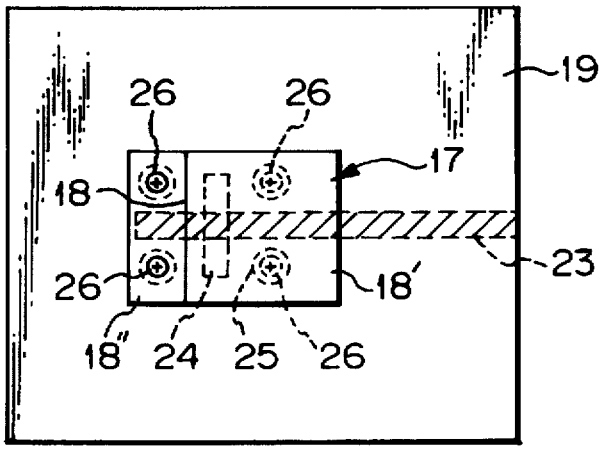
FIG. 6 is a top plan view of the antenna apparatus shown in FIG. 4.

In FIGS. 4~6, a short patch antenna 17 is formed by bending a planar metal plate. The short patch antenna 17 includes a signal radiating portion (corresponding to the radiating element 13 in FIG. 2*a*) 18', a short-circuit portion 18 which forms substantially at a right angle relative to the signal radiating portion 18', and a mounting portion 18" which is formed substantially at a right angle relative to the short-circuit portion 18.

The antenna apparatus also includes a first ground conductor plate 19. The short-circuit portion 18 connects one end of the radiating portion 18' of the short patch antenna 17 to the first ground conductor plate 19 and maintains the spacing between the radiating portion 18', of the short patch antenna 17 and the first ground conductor plate 19 constant. The antenna apparatus further includes a second ground conductor plate 20 arranged in parallel with the first ground conductor plate 19; a film substrate 21 having a strip line 23 formed on the upper surface thereof; a foam dielectric material 22 arranged between and in parallel with the first ground conductor plate 19 and the second ground conductor plate 20 for supporting the film substrate 21; and a coupling hole 24 formed through the ground conductor plate 19.

As can be seen from the cross-sectional view of FIG. 5, the short patch antenna 17 and the strip line 23 are electromagnetically coupled through the coupling hole 24. The foam dielectric material 22 supports the film substrate 21 from both sides thereof in a sandwich form. In other words, there are two layers of the foam dielectric material 22. The first ground conductor plate 19 and the second ground conductor plate 20 are arranged on the top and bottom surfaces of the foam dielectric material layers 22, respectively. As illustrated in FIG. 5, the second ground conductor plate 20 is partially depressed to form four recesses (in FIG. 5, two of these four recesses are illustrated). The recesses constitute ground conductor plate connecting mechanisms 25 each for electrically interconnecting the first and second ground conductor plates 19, 20 with screws 26 and for maintaining the spacing between the ground conductor plates 19, 20. Corresponding to the ground conductor plate connecting mechanisms 25, the film substrate 21 and the foam dielectric material layers 22 are formed with holes extending therethrough for providing columnar openings. The second ground conductor plate 20 is in contact with the first ground conductor plate 19 through the columnar openings formed through the film substrate 21 and the foam dielectric material layers 22, and the first ground conductor plate 19 and the second ground conductor plate 20 are electrically and mechanically connected to each other with four screws 26. Two of the four screws 26 are positioned on the mounting portion 18" of the short patch antenna 17 to fix the short patch antenna 17 on the first ground conductor plate 19 and provide electrical connection therebetween.

Next, the operation of the antenna apparatus according to the third embodiment will be described.

While the antenna apparatus shown in FIGS. 4~6 is similar to the antenna apparatus of the first embodiment (shown in FIG. 2), some differences exist in structure, i.e., the former does not include the first dielectric substrate, but includes the foam dielectric material layers 22 and the ground conductor plate connecting mechanism formed by depressing the second ground conductor plate 20, and so on. However, the operation of the third embodiment as an antenna is similar to that of the first embodiment.

Specifically, a signal propagating through the strip line 23 excites the short path antenna 17 through the coupling hole 24 by electromagnetic coupling. The excited short patch antenna 17 radiates the signal in the air.

The antenna apparatus shown in FIGS. 4~6 does not include the first dielectric substrate, and the inside of the short patch antenna is filled with air so that the distance between a shorted end and an open end of the signal radiating portion 18 of the short patch antenna 17 is approximately $\lambda_0/4$, where $\lambda_0$ is a free space wavelength. Therefore, the short patch antenna 17 is shorter than the radiating element 13 in the first embodiment. In addition, since the inside of the short patch antenna 17 is filled with air and does not contain any dielectric material, no dielectric loss occurs.

In the antenna apparatus of the third embodiment, the strip line 23 is sandwiched between the foam dielectric material layers 22. The foam dielectric material has a dielectric constant substantially close to that of air and a lower dielectric tangent as compared with that of the dielectric substrate. Therefore, the strip line 23 exhibits dielectric loss which is substantially less than the dielectric loss of a line formed on a dielectric substrate.

Also, the ground conductor plate connecting mechanism 25, which is integrally formed with the second ground conductor plate 20 by depression, can be manufactured easily.

Components of the antenna apparatus according to the third embodiment include a planar metal plate, a foam dielectric material, and a film substrate. Since these materials are much cheaper than dielectric substrates, it is possible to reduce the cost required for the components of the antenna apparatus.

As described above, according to the third embodiment, since the inside of the short patch antenna 17 is filled with air, and the antenna apparatus itself is composed of such components as a planar metal plate, foam dielectric material and film substrate, the antenna apparatus of the third embodiment is advantageous over prior art antenna apparatuses in a reduced size of the radiating element, less dielectric loss, and lower cost for the components.

While the third embodiment employs the screws 26 for the interconnection and fixation of the short patch antenna 17, the first ground conductor plate 19 and the ground conductor plate connecting mechanism 25, other connecting means such as rivet or the like may also be used.

In the third embodiment, the ground conductor plate connecting mechanism 25 for connecting the first ground conductor plate 19 to the second ground conductor plate 20 is constituted of recesses formed by depressing the second ground conductor plate 20. Alternatively, the ground conductor plate connecting mechanism 25 may be constituted of a ring spacer, a stop nut or the like. This will be explained with reference to FIGS. 7*a*, 8*a* and 9 which are cross-sectional views respectively showing structures around a ground conductor plate connecting mechanism in the third embodiment of the antenna apparatus according to the present invention.

Figure 7A:
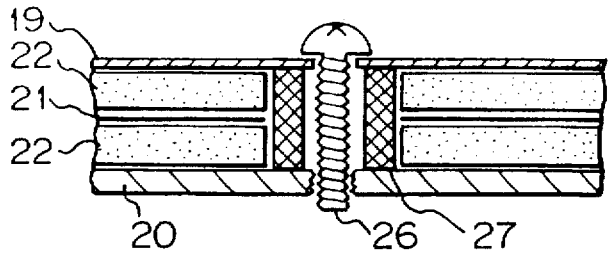
FIG. 7*a* is a cross-sectional view for explaining an alternative to the third embodiment of the antenna apparatus according to the present invention.
Figure 7B:
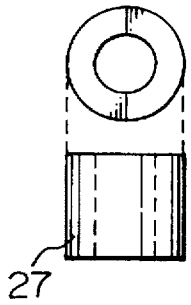
FIG. 7*b* is a cross-sectional view of a ring spacer shown in FIG. 7*a;*

In FIG. 7*a*, a ring spacer 27 (FIG. 7*b*), made of a conductive material, is employed as the ground conductor plate connecting mechanism. A screw 26 for interconnecting and fixing the first ground conductor plate 19 and the second ground conductor plate 20 extends through the ring spacer 27 which electrically interconnects and mechanically fixes these ground conductor plates 19, 20.

Figure 8A:
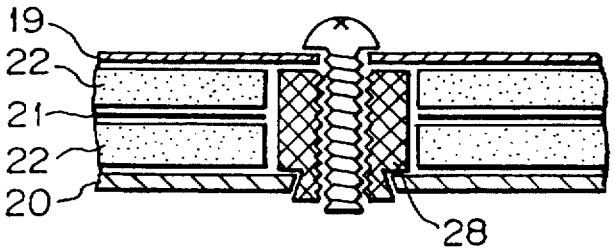
FIG. 8*a* is a cross-sectional view showing a modified example of the structure illustrated in FIG. 7*a;*
Figure 8B:
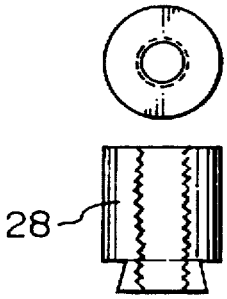
FIG. 8*b* is a cross-sectional view of a stop nut used in the modified example of FIG. 8*a;*

In FIG. 8*a*, a stop nut 28 having a threaded throughhole (FIG. 8*b*) is employed as the ground conductor plate connecting mechanism. The stop nut 28 has a function similar to the ring spacer 27.

Figure 9:
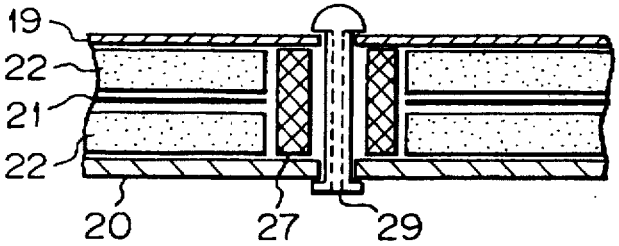
FIG. 9 is a cross-sectional view showing another modified example of the structure illustrated in FIG. 7*a;*

In FIG. 9, the ring spacer 27 is connected and fixed by a rivet 29 in place of the screw 26. The ring spacer 27 in FIG. 9 functions similar to the case of FIG. 7*a*.

The operation and advantages of the antenna apparatuses shown in FIGS. 7*a*, 8*a* and 9 are similar to those of the antenna apparatus according to the third embodiment.

While in the third embodiment, the short patch antenna 17 and the first ground conductor plate 19 are formed by different conductor plates, they may be integrally molded.

Figure 10:
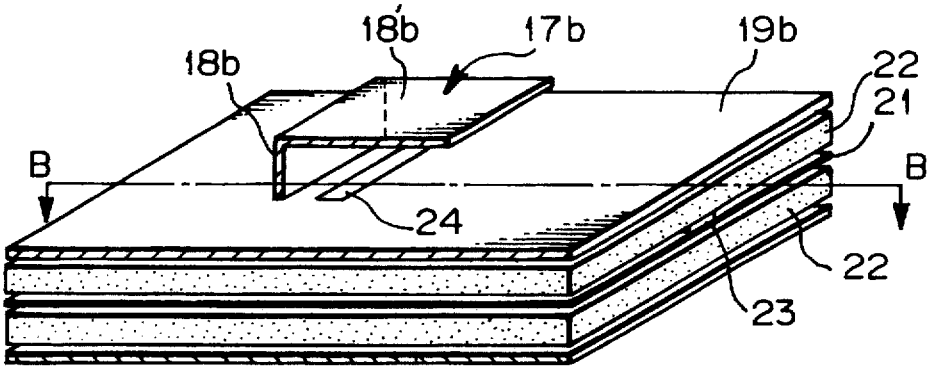
FIG. 10 is a perspective view schematically showing the structure of a fourth embodiment of the antenna apparatus according to the present invention.
Figure 11:
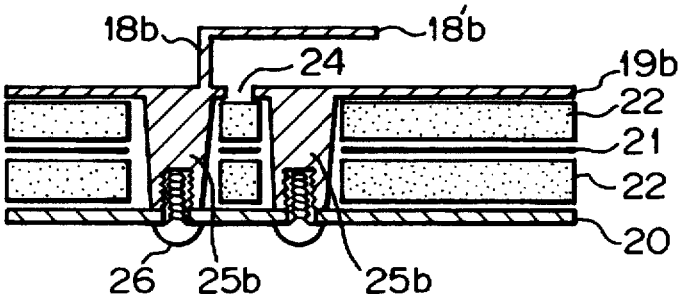
FIG. 11 is a cross-sectional view taken along a B—B line in FIG. 10.

FIG. 10 is a perspective view of a fourth embodiment of the antenna apparatus according to the present invention, and FIG. 11 is a cross-sectional view taken along a line B—B in FIG. 10. In FIGS. 10 and 11, components including a short patch antenna 17~a screw 26 are identical to or correspond to those used in the third embodiment (FIGS. 4~6).

The operation of the antenna apparatus according to the fourth embodiment is the same as that of the third embodiment. The fourth embodiment differs, however, in that a signal radiating portion 18'*b* and a short-circuit portion 18*b* of a short patch antenna 17*b*, a ground conductor plate 19*b* and a ground conductor plate connecting mechanism 25*b* are integrally formed in such a manner that a shape shown in FIGS. 4~6 is formed of resin and that the surface of the integrally formed component is then plated with a conductive material.

The structure as described above reduces the number of required parts and the number of manufacturing steps as well as a cost of the antenna apparatus.

While in the fourth embodiment the signal radiating portion 18'*b* and short-circuit portion 18*b* of the short patch antenna 17*b*, the ground conductor plate 19*b* and the ground conductor plate connecting mechanism 25*b* are integrally molded, alternatively, the short patch antenna 17, the short-circuit portion 18*b* and the first ground conductor plate 19 may be formed as one integral component and the ground conductor plate connecting mechanism 25 and the second ground conductor plate 20 be formed as the other separate integral component.

Figure 12:
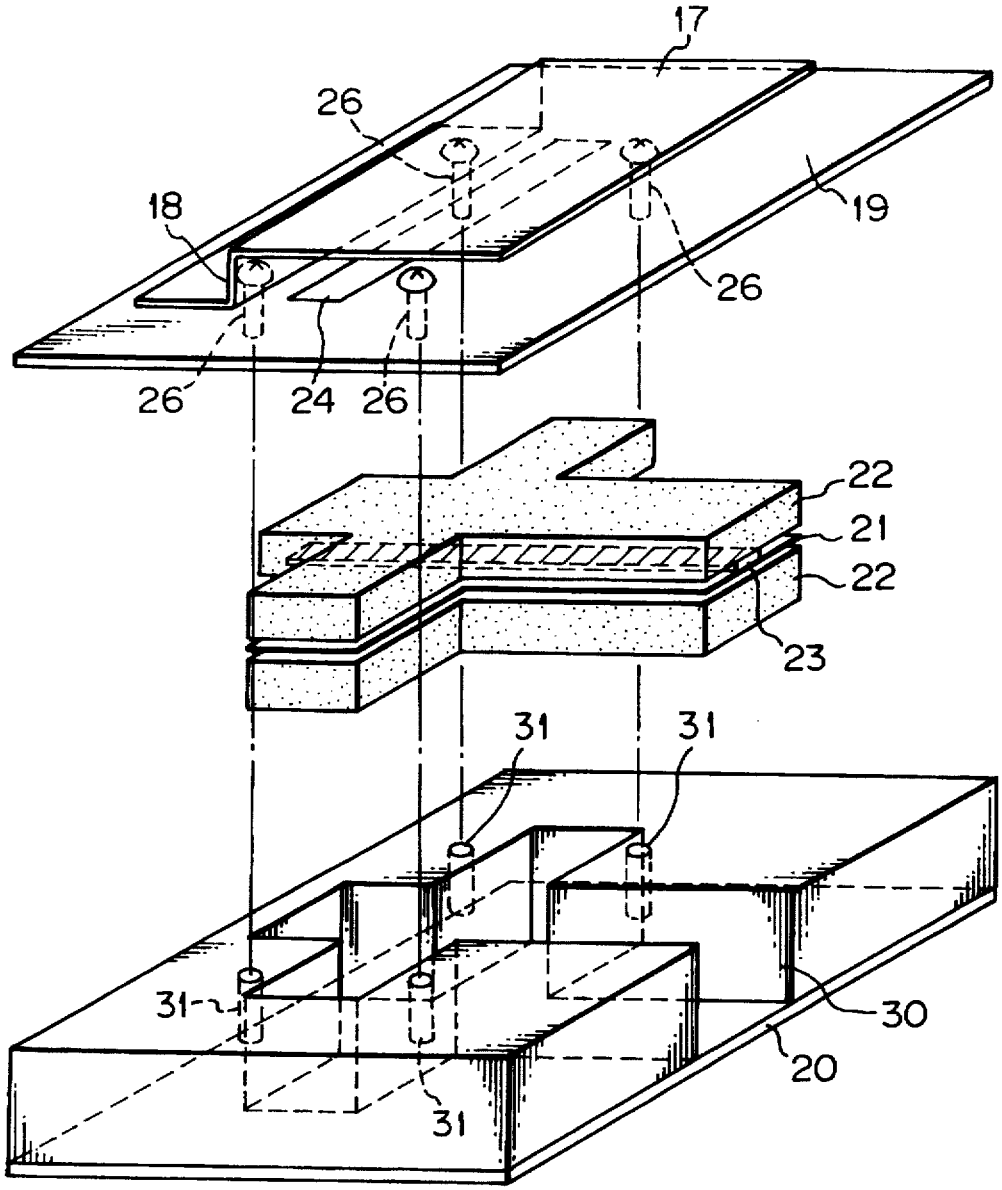
FIG. 12 is an exploded view showing the structure of the fifth embodiment of the antenna apparatus according to the present invention.

A fifth embodiment of the antenna apparatus according to the present invention will next be described with reference to FIG. 12. FIG. 12 shows the antenna apparatus according to the fifth embodiment in a broken form. The antenna apparatus is mainly constituted of three portions. Specifically, in FIG. 12, the upper portion shows a radiating element and a first ground conductor plate of the antenna apparatus; the lower portion shows a second ground conductor plate and a conductor for connecting the first ground conductor plate to the second ground conductor plate; and the middle portion shows a feed line sandwiched between the components of the upper portion and the components of the lower portion. The feed line in this antenna apparatus is a triplate line.

In the upper portion of FIG. 12, a short patch antenna 17, a short-circuit portion 18', the first ground conductor plate 19, a coupling hole 24, and screws 26 are identical to or corresponding to those shown in FIGS. 4~6.

In the middle portion of FIG. 12, while a film substrate 21 formed with a strip line 23 and foam dielectric materials 22 function similarly to their corresponding components shown in FIGS. 4~6, these shown in FIG. 12 have different shapes. More specifically, the foam dielectric materials 22 are only arranged in a portion along the strip line 23 which supplies signals, and in a portion corresponding to a coupling hole 24 which electromagnetically couples the feed line to the radiating element. Since the strip line 23 substantially orthogonally intersects with the coupling hole 24, the foam dielectric materials 22 have a cross shape. The foam dielectric materials 22 sandwiching the strip line 23 therebetween are buried in a conductor block 30 such that the strip line 23 is completely shielded thereby.

In the lower portion of FIG. 12, the second ground conductor plate 20 is identical to or corresponding to that shown in FIGS. 4~6. The conductor block 30 is arranged between the first ground conductor plate 19 and the second ground conductor plate 20 to electrically connect these ground conductor plates 19, 20. The conductor block 30 has an opening in a shape capable of accommodating therein the feed circuit and the coupling portion formed of the film substrate 21 and the foam dielectric materials 22. The conductor block 30 also has screw holes 31 for screws 26 to fix the first ground conductor plate 19 on the conductor block 30.

Four screws 26 are screwed into the respective screw holes 31 to mount the first ground conductor plate 19 on the conductor block 30 and to fix the feed circuit formed of the dielectric materials 22 and the strip line 23, between the first ground conductor plate 19 and the second ground conductor plate 20. Although not shown in FIG. 12, the second ground conductor plate 20 and the conductor block 30 are also connected and fixed to each other with screws or the like.

The basic operation of the antenna apparatus of the fifth embodiment is the same as that of the antenna apparatus of the third embodiment.

However, in the fifth embodiment, since the coupling hole 24 and the strip line 23 is completely shielded by the conductor block 30, the parallel plate mode signal, as described in connection with the first embodiment, is more fully blocked. This results in a further reduction in dielectric loss of the antenna apparatus as well as coupling to other lines.

As described above, according to the fifth embodiment, since the feed circuit and the coupling portion are completely shielded by a conductor block, the dielectric loss of the antenna apparatus is further reduced. Also, similarly to the antenna apparatus of the third embodiment, the antenna apparatus of the fifth embodiment can employ a radiating element of a smaller size and accordingly reduce a manufacturing cost.

It should be noted that such an integral mold made of resin as described in the fourth embodiment may be applied to the antenna apparatus of the fifth embodiment. For example, the conductor block 30 and the second ground conducting plate 20, or, the conductor block 30, the first ground conductor plate 19 and the short patch antenna 17 may be integrally formed of resin and its surface plated with a conductive material.

Figure 3:
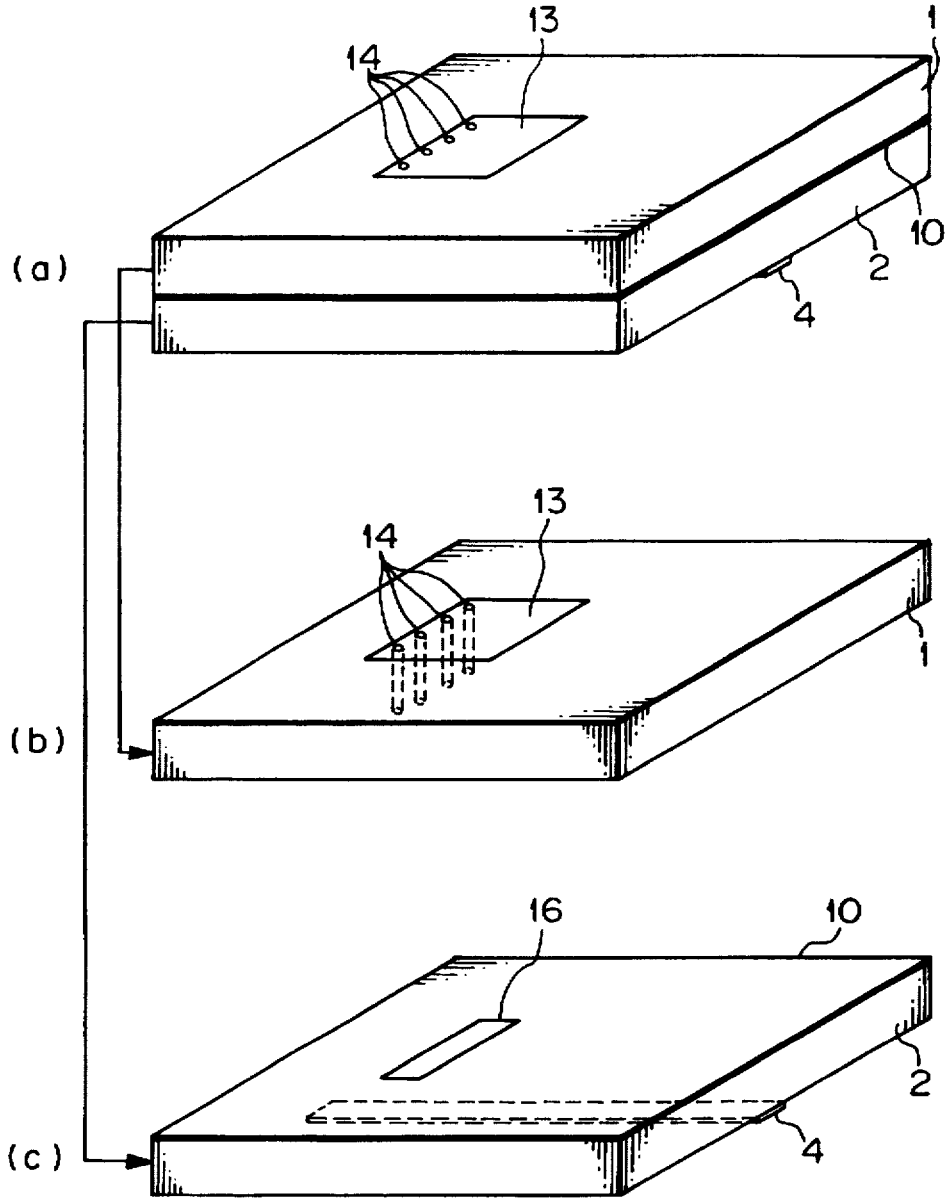
FIG. 3*a* is a perspective view schematically showing the structure of the second embodiment of an antenna apparatus according to the present invention.
FIGS. 3*b* and 3*c* show constituent elements of the antenna apparatus illustrated in FIG. 3*a;*
Figure 13:
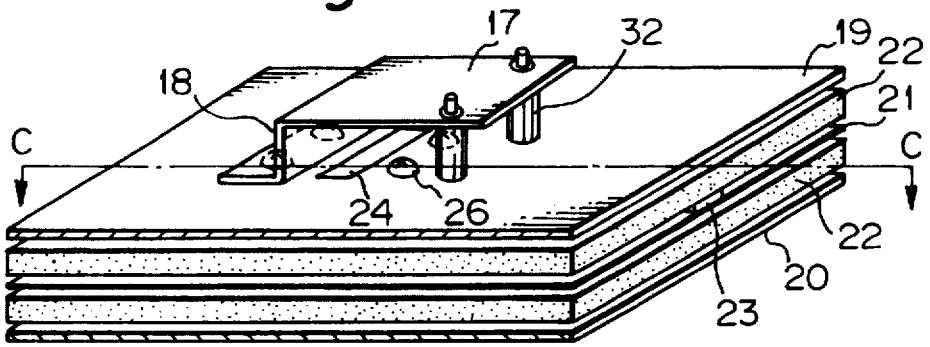
FIG. 13 is a perspective view schematically showing the structure of the sixth embodiment of the antenna apparatus according to the present invention.
Figure 14:
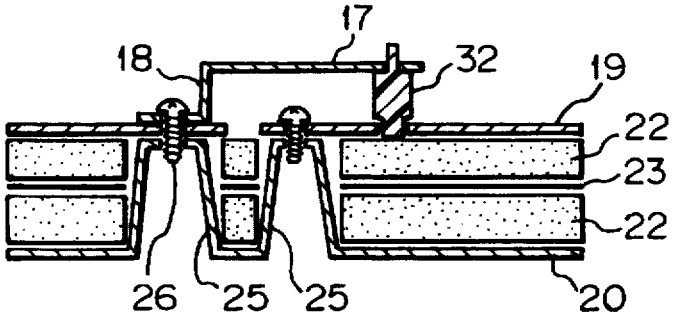
FIG. 14 is a cross-sectional view taken along a line C—C in FIG. 13.

It is preferable for the radiating element 17 of the antenna apparatus of the third embodiment to be provided with a spacer at the non-grounded end to enhance its structural stability. FIG. 13 is a perspective view showing a sixth embodiment of the antenna apparatus according to the present invention, and FIG. 14 is a cross-sectional view taken along a line C—C in FIG. 13. In FIGS. 13 and 14, a dielectric spacer 32 is provided for maintaining the spacing between an open end of the short patch antenna 17, i.e., the end opposite to the end grounded by the short-circuit portion 18, and a ground conductor plate 19. The remaining components are identical to or corresponding to those used in the third embodiment (FIG. 3).

The electrical operation of the sixth embodiment is the same as that of the antenna apparatus according to the third embodiment.

The strongest electric field is generated at the open end of the short patch antenna 17. For this reason, a change in the spacing between the open end of the short patch antenna 17 and the ground conductor plate 19 would greatly affect the operating characteristics of the short patch antenna 17, particularly, the resonance frequency characteristic and resonance band characteristic. Therefore, a mechanism is required to maintain the spacing at an appropriate distance. The sixth embodiment has the dielectric spacer 32 arranged to have a length matching an optimal spacing between the open end of the short patch antenna 17 and the ground conductor plate 19 to thereby stabilize the characteristics of the short patch antenna 17.

While a variety of shapes may be considered for the dielectric spacer 33, the smallest possible is desired. This is because a larger dielectric spacer 32 would result in an increase in dielectric loss in the short patch antenna 17.

According to the sixth embodiment, since the spacer 32 maintains constant the spacing between the open end of the short patch antenna 17 and the ground conductor plate, it is possible to provide a stable antenna apparatus which has a high accuracy in terms of the structure as well as maintaining its performance even if the antenna apparatus is subjected to physical shock such as vibrations. In addition, similarly to the third embodiment, the antenna apparatus of the sixth embodiment can employ a radiating element of a smaller size and reduce manufacturing costs and dielectric loss.

It should be noted that the spacer 32 of the sixth embodiment may also be used in the antenna apparatuses of the third~fifth embodiments.

Figure 15:
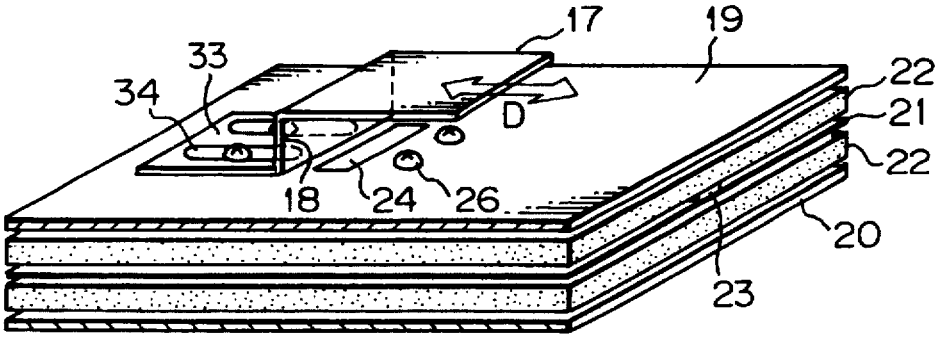
FIG. 15 is a perspective view schematically showing the structure of the seventh embodiment of the antenna apparatus according to the present invention.
Figure 16:
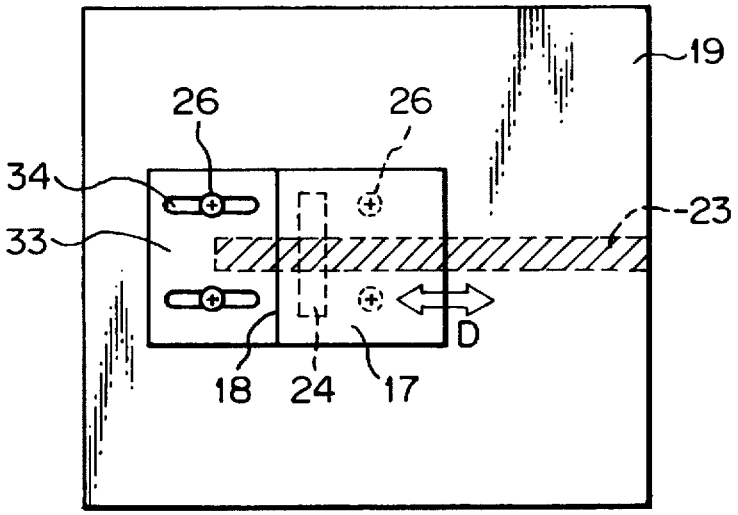
FIG. 16 is a top plan view of the antenna apparatus illustrated in FIG. 15.

It is also desirable for the position of the radiating element in the antenna apparatus according to the third embodiment to be adjustable. FIG. 15 is a perspective view of a seventh embodiment of the antenna apparatus according to the present invention, and FIG. 16 is a top plan view of the same. In FIGS. 15 and 16, a short patch antenna 17 has a partial bent portion 33 for mount on a first ground conductor plate 19. Elongated holes 34 are formed through the bent portion 33 for adjusting the position of the short patch antenna 17. Screws 26 are inserted through the respective elongated holes 34 to electrically interconnect the short patch antenna 17 to the first ground conductor plate 19 and mechanically fix the short patch antenna 17 on the first ground conductor plate 19. The remaining components are identical to or corresponding to those used in the third embodiment (FIG. 4).

The basic electrical operation of the antenna apparatus of the seventh embodiment is the same as that of the antenna apparatus of the third embodiment. In the antenna apparatus of the seventh embodiment, however, the elongated holes 34 are formed through the bent portion 33 such that the short patch antenna 17 is movable in the directions indicated by arrows D, thereby achieving an optimum positional relationship between the short patch antenna 17 and the coupling hole 24.

Generally, as the coupling hole 24 is formed in the vicinity of the short-circuit portion 18 of the short patch antenna 17, the short patch antenna 17 and the triplate line 23 electromagnetically couple to each other over a wider band, so that the matching can be achieved over a wider band. However, if the electromagnetic coupling extends over an extremely wide band, an input impedance of the short patch antenna 17 largely fluctuates in the band, thus making the matching difficult. To solve this problem, the antenna apparatus according to the seventh embodiment enables the adjustment of the position of the short patch antenna 17 to allow the matching in an optimally wide band.

The adjustment may be made, for example, in the following manner. As the short-circuit portion 18 is close to the coupling hole 24, the coupling over a wider band is provided. In this event, for establishing the matching, the characteristic in the Smith chart may be within a circle defined by predetermined VSWR (for example, VSWR=1.5) at the center of the Smith chart. Thus, the short-circuit portion 18 is positioned as close as possible to the coupling hole 24 as long as the characteristic on the Smith chart remains within the circle.

According to the seventh embodiment, by providing the elongated holes 34 for mounting the short patch antenna 17 on the first ground conductor plate 19, the positional relationship between the short patch antenna 17 and the coupling hole 24 is adjustable. This enables the degree of the electromagnetic coupling to be adjusted between the radiating element 17 and the feed circuit, whereby an optimal condition can be established. It is therefore possible, similarly to the third embodiment, to provide antenna apparatus which can easily establish the matching between the radiating element and the feed line over a wider band. It is also possible to provide an antenna apparatus which can employ a smaller radiating element and reduce a cost and dielectric loss.

It should be noted that the elongated holes may also be formed in the fourth~sixth embodiments to make the position of the radiating element adjustable.

Also, when a microstrip line is used in place of a triplate line as the feed circuit for the antenna apparatus of the seventh embodiment, similar advantages can be produced.

Figure 17:
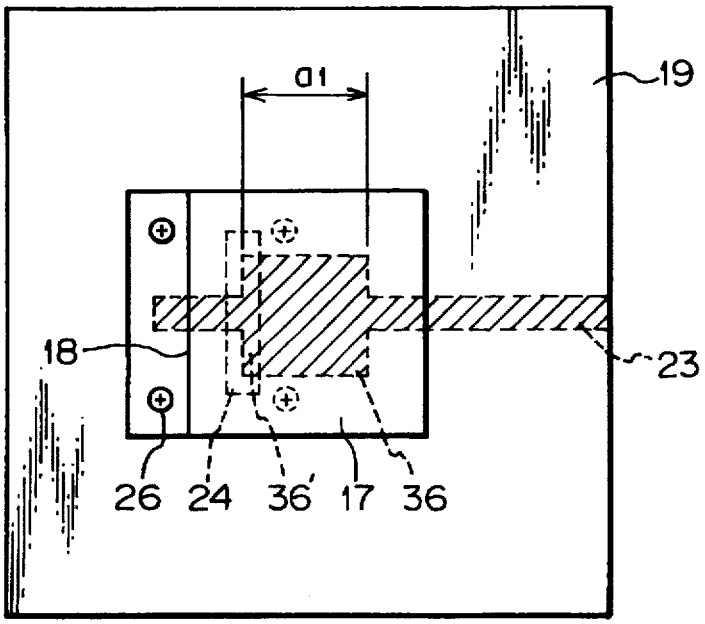
FIG. 17 is a top plan view schematically showing the structure of the eighth embodiment of the antenna apparatus according to the present invention.

Next, an eighth embodiment of the antenna apparatus according to the present invention will be described with reference to FIG. 17. FIG. 17 is a top plan view of the antenna apparatus according to the eighth embodiment. A hatched region 36 indicates a part of a strip line 23 which has a portion extended near a coupling hole 24. Since the characteristic impedance of a line becomes lower as the width of the line is wider, the region 36 is called a low impedance region. The low impedance region 36 is positioned near a feed point of the strip line 23 relative to the coupling hole 24. This is because the low impedance region 36 also functions as a transformer. An end portion 36' of the low impedance region 36 is positioned to overlap with a portion of the coupling hole 24. This is because the largest current flows through the end portion 36' and a larger coupling is provided by overlapping the end portion 36' with the coupling hole 24. The remaining components are identical to or correspond to those used in the third embodiment (FIG. 4).

The basic electrical operation of the antenna apparatus of the eighth embodiment is the same as that of the antenna apparatus of the third embodiment. In the eighth embodiment, however, the strip line 23 has a width-extended portion near the coupling hole 24 to form the low impedance region 36. As the characteristic impedance of a line is lower, a larger current flows through the line, resulting in a stronger magnetic field around the line. As a result, the coupling hole 24 is more strongly excited, whereby the short patch antenna 17 and the strip line 23 electromagnetically couple to each other over a wider band.

As described above in connection with the seventh embodiment, if the electromagnetic coupling is enabled over a wider band, the matching can also be established over a wider band. However, electromagnetic coupling in an extremely wide band would result in difficulties in establishing matching. Therefore, the width of the low impedance region 36 may be adjusted to obtain the most appropriate amount of coupling. Specifically, similarly to the case of the seventh embodiment, the width of the low impedance region 36 is extended as much as possible on the assumption that the characteristic on the Smith chart remains within a circle defined by a predetermined VSWR (for example, VSWR= 1.5) at the center thereof, in order to simultaneously realize a wider band coupling and desired matching.

If the strip line 23 is made to have the same width as the low impedance region 36 over its entire length, an area occupied by the strip line 23 would be wider, which would be disadvantageous for use in an array antenna in which feed lines are arranged in a complicated configuration. For this reason, the low impedance region 36 should be arranged only near the coupling hole 24.

When appropriately selecting the line width of the low impedance region 36 with the length al thereof selected to be $\lambda p/4$ ($\lambda p$ is a wavelength within the line), the low impedance region 36 also serves as an impedance transformer which provides easy matching between the strip line 23 and the antenna 17.

According to the eighth embodiment, since the low impedance region 36 is partially formed in the feed line near the coupling hole 24 for realizing the electromagnetic coupling over a wider band, the matching between the radiating element and the feed line can be easily established over a wider band. In addition, similarly to the third embodiment, it is possible to provide an antenna apparatus which can employ a radiating element of a smaller size and reduce a cost and dielectric loss.

It should be noted that the low impedance region 36 as in the eighth embodiment may also be provided in the strip line in the third~seventh embodiments.

Also, when a triplate line is used in place of the strip line as the feed circuit for the antenna apparatus of the eighth embodiment, similar effects can be produced.

Figure 18:
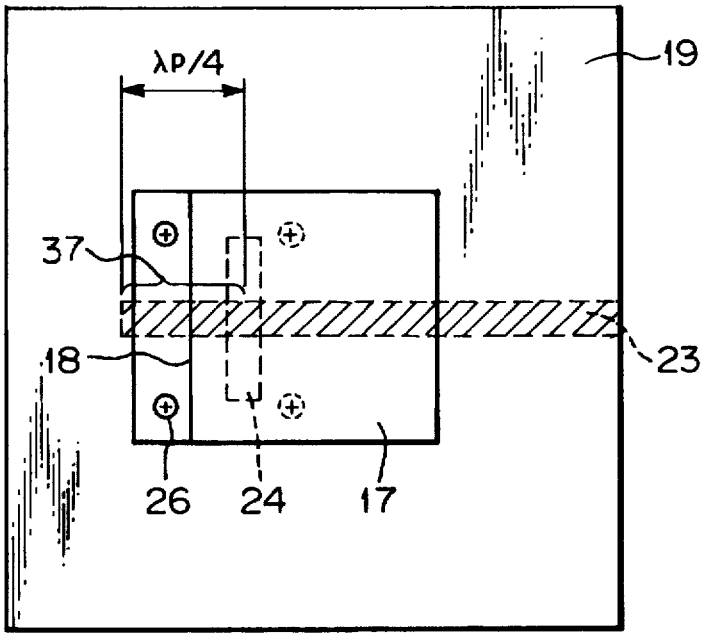
FIG. 18 is a top plan view schematically showing the structure of the ninth embodiment of the antenna apparatus according to the present invention.

In the antenna apparatus of the eighth embodiment, the low impedance region 36 arranged in the feed line enables the matching over a wider band. A similar effect to this may also be provided by arranging an open stub in the feed line. FIG. 18 is a top plan view showing a ninth embodiment of the antenna apparatus according to the present invention. In FIG. 18, an area denoted by 37 is an open stub which is an extension of a strip line 23 over a length of approximately $\lambda p/4$ ($\lambda p$ is a wavelength within the line) from the center of a coupling hole 24. The remaining structure is the same as that of the antenna apparatus of the eighth embodiment.

The basic electrical operation of the antenna apparatus of the ninth embodiment is the same as that of the antenna apparatus of the third embodiment. In the structure of the ninth embodiment, the open stub 37 causes an impedance near the coupling hole 24 to be substantially zero, which results in a larger current flowing through the feed line and a stronger magnetic field around the coupling hole 24. As a result, the coupling hole 24 is more strongly excited, whereby the short patch antenna 17 and the strip line 23 electromagnetically couple to each other over a wider band. Similarly to the case of the eighth embodiment, the electromagnetic coupling over a wider band enables the matching over a wider band. However, the electromagnetic coupling in an extremely wide band would result in difficulties in establishing the matching. If the electromagnetic coupling is realized in an excessively wide band, a current amount near the coupling hole 24 may be adjusted by increasing or decreasing the length of the open stub 37 around $\lambda p/4$. The electromagnetic coupling becomes the largest when the length of the open stub 37 is $\lambda p/4$. A reactance component becomes capacitive when the open stub 37 is shorter than $\lambda p/4$ and inductive when longer than $\lambda p/4$. The length of the open stub 37 may be adjusted in order to obtain optimal matching.

According to the ninth embodiment, since the open stub 37 is provided in the feed line, the matching between the radiating element and the feed line can be easily established over a wider band. Also, similarly to the third embodiment, the antenna apparatus of the ninth embodiment can employ a radiating element of a smaller size, be produced at a lower cost, and reduce dielectric loss.

The eighth embodiment may be combined with the ninth embodiment to provide an antenna apparatus having both the low impedance region 36 and the open stub 37. Also, when a triplate line is used in place of the strip line as the feed circuit for the antenna apparatus of the ninth embodiment, similar effects can be produced.

Figure 19:
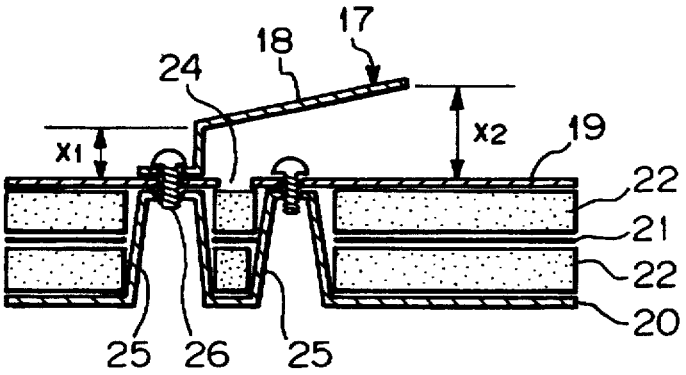
FIG. 19 is a cross-sectional view schematically showing the structure of the tenth embodiment of the antenna apparatus according to the present invention.

In the third~ninth embodiments described above, the spacing between the short patch antenna 17 serving as a radiating element and the ground conductor plate 19 is constant over the length of the short patch antenna 17. Alternatively, this spacing may be different at the grounded end and the open end of the short patch antenna 17. FIG. 19 is a cross-sectional view showing a tenth embodiment of the antenna apparatus according to the present invention. FIG. 19 shows a similar cross-sectional view to FIG. 5, however, the tenth embodiment in FIG. 19 differs from FIG. 5 in that the spacing between a signal radiating portion 18 of a short patch antenna 17 and a ground conductor plate 19 differs over the entire length of the signal radiating portion 18. Referring more specifically to FIG. 19, assuming that a spacing between the short patch antenna 17 and the signal radiating portion 18 at a grounded end is designated x1 and a spacing at an open end opposite to the grounded end is designated x2, $x1<x2$ is satisfied.

The basic electrical operation of the antenna apparatus of the tenth embodiment is the same as that of the antenna apparatus of the third embodiment. As described above, the largest electric field is present at the open end of the short patch antenna 17. Further, generally, as the spacing between the short patch antenna 17 and the first ground conductor plate 19 has a larger volume, the short patch antenna 17 resonates over a wider band. Thus, the antenna apparatus of the tenth embodiment, having a larger volume in the largest electric field region, resonates over a wider band, as compared with the antenna apparatus of the third embodiment which has the short patch antenna 17 arranged in parallel with the ground conductor plate 19. Since the resonance over a wider band results in electromagnetic coupling over a wider band, the matching between the radiating element and the feed line can be established over a wide band, as is the case of the eighth and ninth embodiments. However, if the electromagnetic coupling is formed over an excessively wide band to cause difficulties in establishing the matching, the spacing x2 between the open end and the ground conductor plate 19 may be reduced for adjustment.

According to the tenth embodiment, since the spacing between the radiating element 17 and the ground conductor plate 19 is varied so as to achieve resonance over a wider band, it is possible to provide an antenna apparatus for which it is easy to establish the matching between the short patch antenna 17 and the feed line over a wider band which can employ a radiating element of a smaller size and reduce dielectric loss be produced at a lower cost similarly to the third embodiment.

The short patch antenna 17 of the tenth embodiment may be provided with a dielectric spacer as shown in the sixth embodiment to stably maintain the spacing x2 between the open end of the short patch antenna 17 and the ground conductor plate 19.

Figure 20:
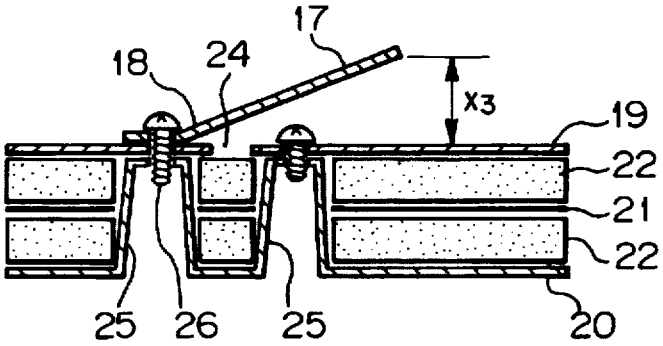
FIG. 20 is a cross-sectional view schematically showing the structure of the eleventh embodiment of the antenna apparatus according to the present invention.

The antenna apparatus of the tenth embodiment may be modified as shown in FIG. 20. FIG. 20 shows a cross-sectional view of an eleventh embodiment of the antenna apparatus according to the present invention. In FIG. 20, there is no spacing at a grounded end of a short patch antenna 17, while a spacing at an open end opposite to the grounded end is selected to be x3, where $x3>0$ is satisfied.

The operation and effect of the antenna apparatus of the eleventh embodiment are the same as those of the antenna apparatus of the tenth embodiment.

Figure 21:
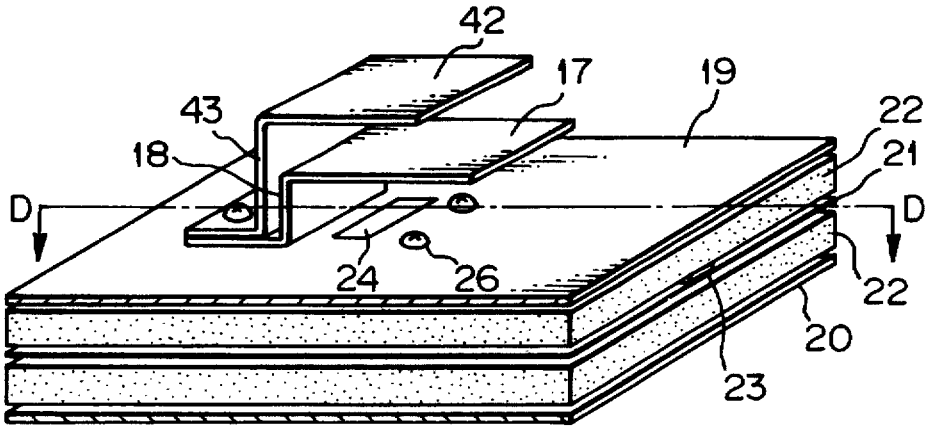
FIG. 21 is a perspective view schematically showing the structure of the twelfth embodiment of the antenna apparatus according to the present invention.
Figure 22:
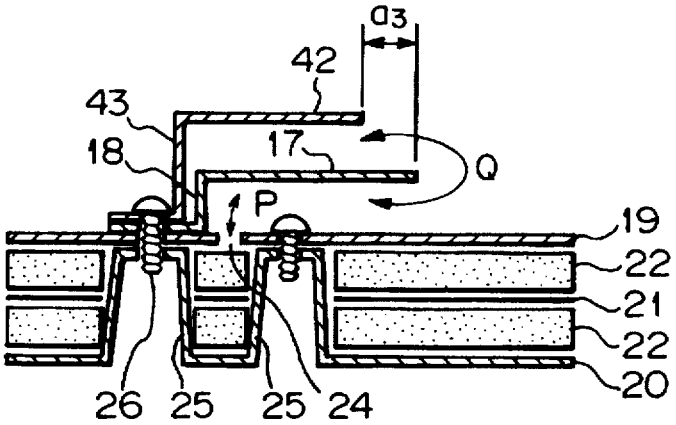
FIG. 22 is a cross-sectional view taken along a D—D line in FIG. 21.

Next, a twelfth embodiment of the antenna apparatus according to the present invention will be described with reference to FIGS. 21 and 22. FIG. 21 shows a perspective view of the antenna apparatus according to the twelfth embodiment, and FIG. 22 is a cross-sectional view taken along a line D—D in FIG. 21. In FIGS. 21 and 22, the antenna apparatus includes an upper short patch antenna 42 arranged above a short patch antenna 17 and having a short-circuit portion 43. Short-circuit portions 18, 43 are arranged in contact with each other or spaced by a predetermined distance in parallel with each other. The remaining structure is the same as that of the respective antenna apparatuses described in the foregoing embodiments.

Since the antenna apparatus of the twelfth embodiment has the two short patch antennas 17 and 14, a resonance band is extended according to the same principle that a combination of two resonators results in a lower Q value. The short patch antenna 17 is coupled to a feed line through a coupling hole 24 as indicated by arrows P in FIG. 21, while the upper short patch antenna 42 is coupled to the feed line through openings formed through the short patch antennas 17 and 42 as indicated by arrows Q in FIG. 22. The short patch antennas 17 and 42 correspond to separate resonators.

Since the resonance band is extended as described above, the matching between the short patch antennas 17, 42 and the feed line can be achieved over a wider band, as is the case of the tenth embodiment. The coupling between the two short patch antennas 17 and 42 becomes larger by reducing the distance a3 between the open ends thereof. If the electromagnetic coupling is made over an excessively wide band to cause difficulties in establishing the matching, the distance a3 between the open ends of the short patch antennas 17 and 42 may be increasingly adjusted to narrow the resonance band.

According to the twelfth embodiment, double short patch antennas permit easy matching thereof with the feed line over a wider band. In addition, similarly to the third embodiment, the twelfth embodiment provides an antenna apparatus which can employ a radiating element of a smaller size, be produced at a lower cost and reduce dielectric loss.

The short patch antennas 17, 42 in the twelfth embodiment may also be provided with a spacer for maintaining the spacing between the open end of each short patch antenna 17 and the ground conductor plate 19, as in the sixth embodiment.

Figure 23:
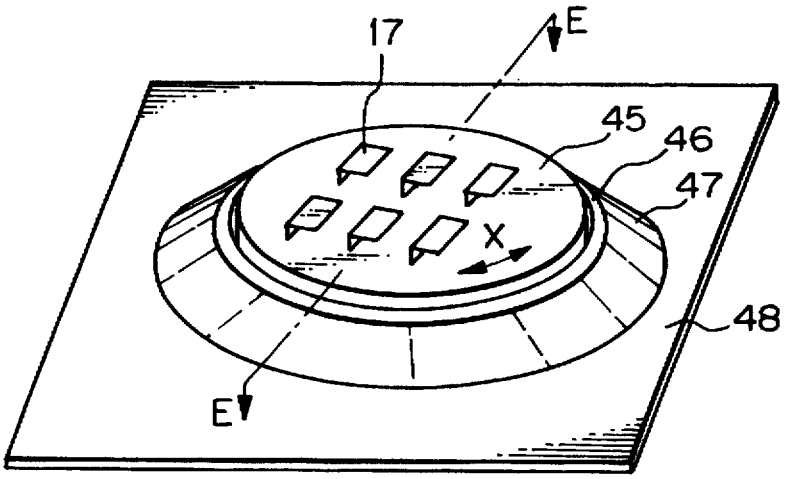
FIG. 23 is a perspective view schematically showing the structure of the thirteenth embodiment of the antenna apparatus according to the present invention.
Figure 24:
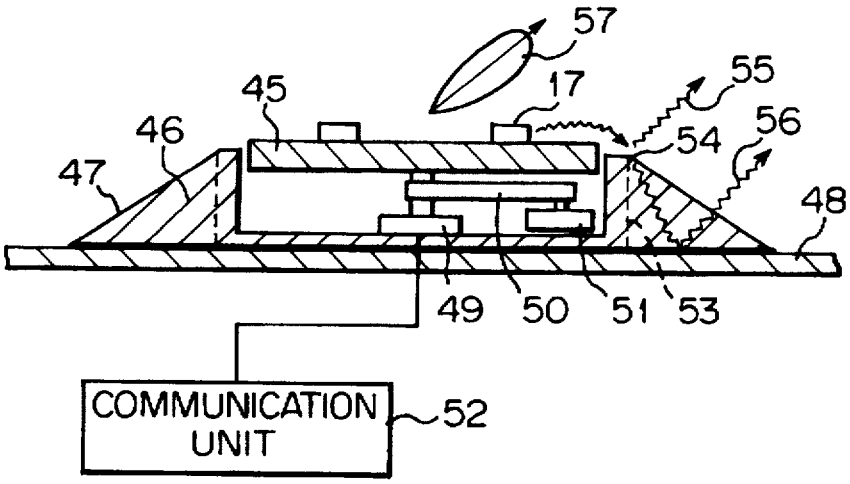
FIG. 24 is a cross-sectional view taken along an E—E line in FIG. 23.

FIG. 23 shows a perspective view of a thirteenth embodiment of the antenna apparatus according to the present invention, and FIG. 24 is a cross-sectional view taken along a line E—E in FIG. 23.

Referring first to FIG. 23, the antenna apparatus includes an antenna section 45 which has a dielectric material on which a ground conductor plate is formed, a single or plurality of short patch antennas 17 carried on the ground conductor plate, a feed circuit for supplying signals to the short patch antennas 17, and a coupling hole for coupling the feed circuit to the short patch antennas 17. The antenna section 45 corresponds to the antenna apparatuses of the third~twelfth embodiments. The antenna section 45 is arranged for rotation in the directions indicated by arrows X in FIG. 23. The antenna apparatus also includes a conductive housing 46 for accommodating a motor, a rotary joint or the like, later described. The top end of the housing 46 is positioned at substantially the same level as the antenna section 45. The antenna apparatus further includes a conductive tapered portion 47 arranged around the housing 46 and a conductor plate 48 on which the housing 46 and the tapered portion 47 are placed.

Referring next to FIG. 24, a rotary joint 49 is arranged at the center of rotation of the antenna section 45 for supplying signals to the short patch antennas 17. A belt 50 transmits a rotating force from a motor 51 to the rotary joint 49 for rotating the antenna section 45. A communication unit 52 is incorporated therein a transmitter, a receiver and other units required in accordance with the operation of the antenna apparatus.

The thirteenth embodiment provides an antenna apparatus which rotates its antenna section in the horizontal direction to direct a beam in a desired direction. This antenna apparatus may be used, for example, for a mobile terminal in mobile satellite communications. When satellite communications are performed using a stationary satellite in a high latitude region relative to earth, the satellite is positioned at a low elevation angle, and the beam of the antenna must be set at a low elevation angle. For this reason, an antenna having a radiation pattern in a low elevation angle direction is required. The short patch antenna 17 is a typical example of such an antenna.

Figure 25:
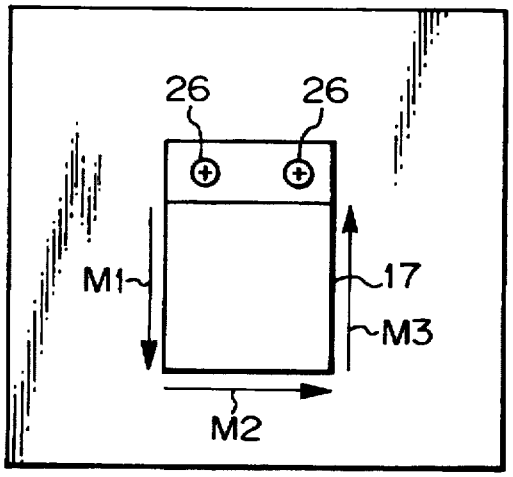
FIGS. 25 and 26 are diagrams for explaining the characteristics of a short patch antenna.
Figure 26:
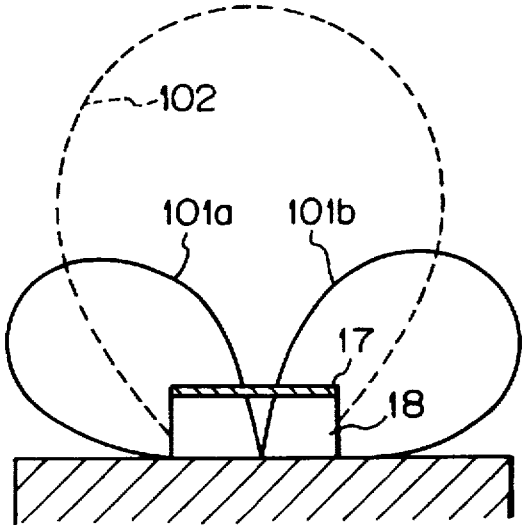

Radiation patterns of circularly polarized waves of the short patch antenna will be explained with reference to FIGS. 25 and 26. FIG. 25 is a top plan view of the short patch antenna 17, and FIG. 26 is a view of the short patch antenna 17 from the open end side thereof. Three sides of the short patch antenna 17 are opened so that they serve as radiation sources. The radiation sources are equivalent to magnetic currents M1~M3 along the respective sides of the short patch antenna 17. Therefore, as shown in FIG. 26, the short patch antenna 17 has a low elevation angle radiation pattern 101*a* on the left side on the plane of the drawing and another low elevation angle radiation pattern 101*b* on the right side. The pattern 101*a* represents a right-handed circularly polarized wave, and the pattern 101*b* represents a left-handed circularly polarized wave. It should be noted that a pattern 102 of a circular patch antenna of two-point feed type presents a low gain at a low elevation angle.

When used in mobile satellite communications, the conductor plate 48 in the thirteenth embodiment may correspond to a roof of an automobile or a deck of a ship. It should be noted that while an antenna apparatus of this kind generally have a radome, it is omitted since it is not an essential constituent of the invention.

The basic operation of the antenna apparatus as described above will be explained with reference again to FIG. 24.

The antenna section 45 including the short patch antenna 17 forms a beam 57 in a particular low elevation angle direction. This antenna section 45 is rotated by the motor 51 through the belt 50 to direct the beam 57 in a desired direction. The antenna performs transmission and reception in this state. A received signal is transferred to the communication unit 52 through a feed line in the rotary joint 49 for communications.

Since the transmission characteristic and reception characteristic of an antenna is the same, the transmission characteristic will be described below as an example. Among waves radiated from the short patch antenna 17, waves propagating in the horizontal direction are scattered by an edge portion of the housing 46. Particularly, if the outer wall of the housing 46 is substantially perpendicular to the conductor plate 48 as indicated by a dotted line 53, and the edge portion 54 of the housing 46 is formed at substantially a right angle, large scattered waves 55, 56 are generated. The wave 55 scattered in the beam direction of the antenna and the scattered wave 56 reflected by the conductor plate 48 and propagating in the beam direction of the antenna largely affect an original beam 57 of the antenna. This influence may cause deformation of the original radiation characteristic of the antenna, thereby failing to provide a desired characteristic. While such adverse influence may be prevented by completely burying the antenna in the conductor plate 48, such a configuration is difficult to be implemented when the conductor plate 48 is a roof plate of an automobile or the like.

Thus, the taper 47 shown in FIGS. 23 and 24 may be arranged around the outer periphery of the housing 46 to prevent the adverse influence caused by scattered waves.

The taper 47 beginning from the edge portion 54 of the housing 46 forms a large obtuse angle with the edge portion 54 of the housing 46. In other words, the edge portion 54 of the housing 46 smoothly contacts the conductor plate 48. Since the taper thus formed reduces the level of scattered waves at the edge portion 54 of the housing 46, the scattered wave 55 which possibly affects the beam 57 of the antenna is also reduced. The taper 47 also eliminates the scattered wave 56. The scattered waves 55 and 56 are reduced in this way, so that the radiation characteristic suffers from less deterioration.

As described above, according to the thirteenth embodiment, the taper 47 is formed around the outer periphery of the housing 46 so that the housing 46 smoothly contacts the conductor plate 48, and scattered waves caused by an end portion of the housing 46 can be reduced, thereby decreasing deterioration in the original radiation characteristic of the antenna.

It should be noted that better effects are produced when the taper 47 has a more gentle taper angle. However, scattered waves will not be reduced so much even if the edge portion 54 of the housing 46 is formed with a rounding much smaller than the wavelength or with a taper.

Figure 27:
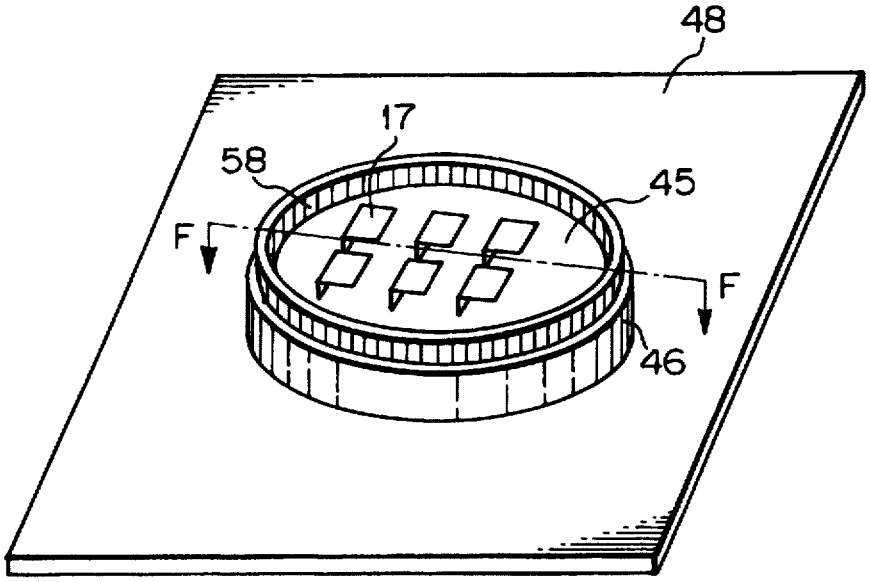
FIG. 27 is a perspective view schematically showing the structure of the fourteenth embodiment of the antenna apparatus according to the present invention.
Figure 28:
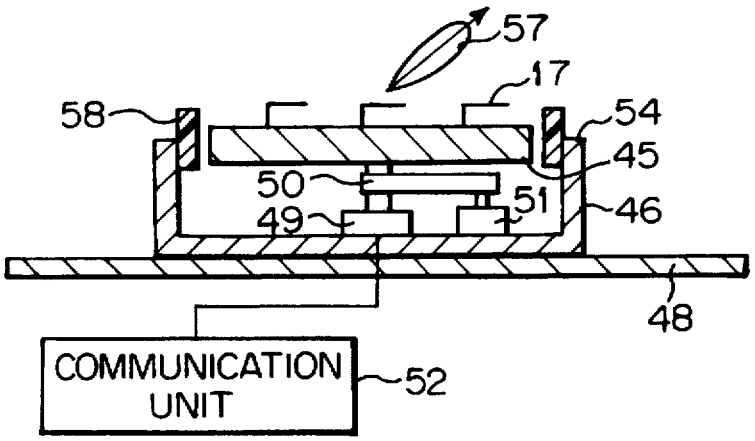
FIG. 28 is a cross-sectional view taken along an F—F line in FIG. 27.

In place of forming a gentle edge portion 54 of the housing 46 by means of the taper 47, a wave absorbing member may be provided for reducing scattered waves. FIG. 27 shows a fourteenth embodiment of the antenna apparatus according to the present invention, and FIG. 28 is a cross-sectional view taken along a line F—F in FIG. 27. In FIGS. 27 and 28, the antenna apparatus includes a wave absorbing member 58 arranged inside an edge portion 54 of a housing 46. The remaining components are the same as those used in the thirteenth embodiment.

In the antenna apparatus according to the fourteenth embodiment, most waves radiated from short patch antennas 17 and propagating in the horizontal direction are absorbed by the wave absorbing member 58 arranged inside the edge portion 54 of the housing 46. Since very few scattered waves remain on the edge portion 54 of the housing 46, the adverse influence on an antenna beam 57 due to the scattered waves is reduced. In addition, the adverse influence on machines placed around the antenna apparatus is also reduced.

Figure 29:
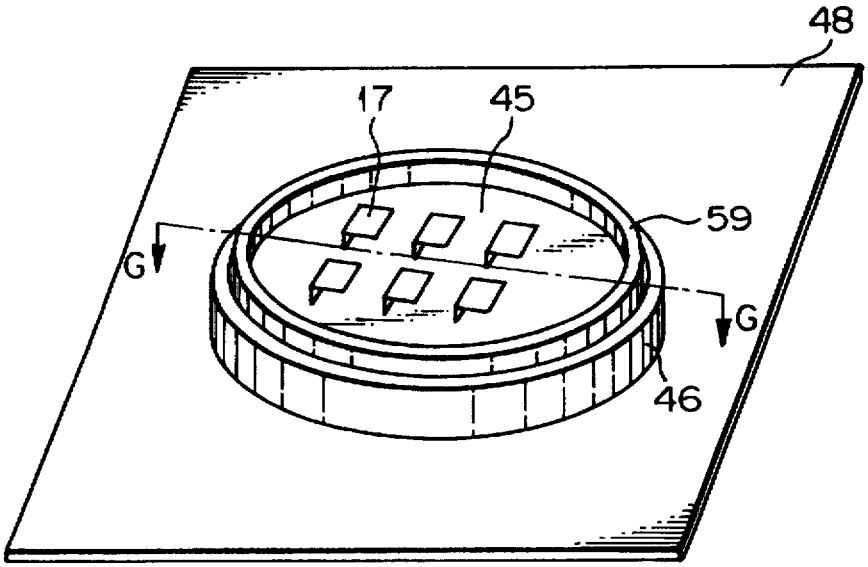
FIG. 29 is a perspective view schematically showing the structure of the fifteenth embodiment of the antenna apparatus according to the present invention.
Figure 30:
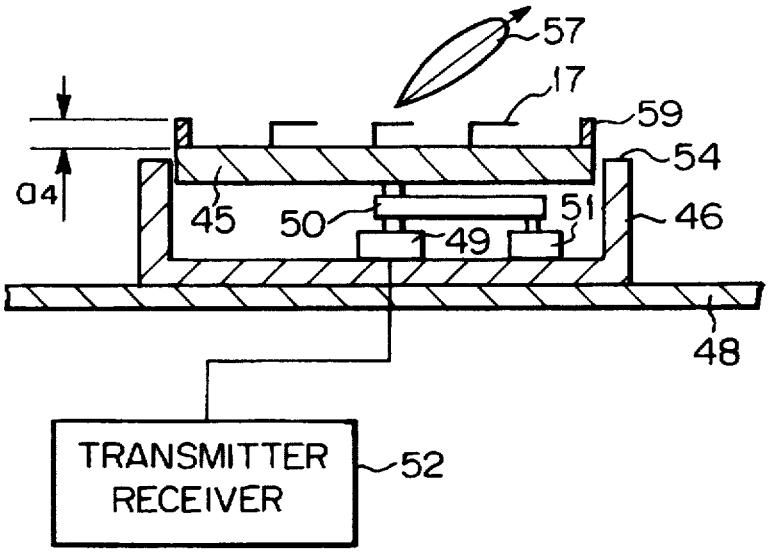
FIG. 30 is a cross-sectional view taken along a G—G line in FIG. 29.

The antenna apparatuses according to the thirteenth and fourteenth embodiments intend to prevent the generation of scattered waves. Alternatively, the phases of generated scattered waves may be modified so as to limit the influence of the scattered waved on radiation patterns to regions in which such influence does not cause any problem with respect to the operation of the antenna apparatus. FIG. 29 shows a perspective view of a fifteenth embodiment of the antenna apparatus according to the present invention, and FIG. 30 is a cross-sectional view taken along a line G—G in FIG. 29. In FIGS. 29 and 30, a ground conductor plate in an antenna section 45 has an upright bent portion 59. The bent portion 59 serves to elongate propagating paths of waves radiated from short patch antennas 17 and propagating in the horizontal direction. The remaining components are the same as those used in the thirteenth embodiment.

The basic operation of the antenna apparatus of the fifteenth embodiment is the same as the antenna apparatus of the thirteenth embodiment except that the bent portion 59 serves to elongate propagating paths of waves propagating in the horizontal direction, as described above.

Specifically, the bent portion 59 in the antenna apparatus of the fifteenth embodiment operates in the following manner. Waves radiated from the short patch antennas 17 and propagating in the horizontal direction are scattered by an edge portion 54 of a housing 46. The bent portion 59 causes such waves propagating in the horizontal direction to run a longer propagating path. It is therefore possible to adjust a direction in which stronger scattered waves exist by changing the height a4 of the bent portion 59.

Figure 31:
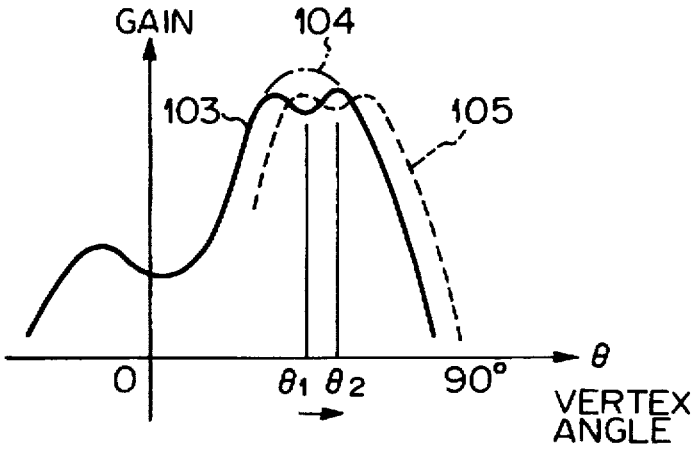
FIG. 31 is a radiation pattern diagram for explaining the operation of the antenna apparatus illustrated in FIG. 29.

The foregoing operation will be further described with reference to FIG. 31. A one-dot-chain line 104 represents a radiation pattern when no scattered waves are generated on the edge portion 54 of the housing 46. However, if scattered waves are generated, the radiation pattern changes to one that is represented by a solid line curve 103. Specifically, the gain of a main beam is reduced in a direction of an angle θ1 due to the influence of the scattered waves, whereby the characteristic of the antenna apparatus is caused to deteriorate in the direction of the angle θ1. On the other hand, a radiation characteristic of the antenna apparatus having the bent portion 59 may be represented by a dotted curve 105 since propagating paths of scattered waves in the horizontal direction are elongated to change the phases of the scattered waves. In other words, the direction in which the gain is reduced is changed from θ1 to θ2 (θ1<θ2). An amount of change (θ2–θ1) is larger as a phase delay amount increase. Therefore, the bent portion 59 with a larger height a4 causes the direction in which the gain of the main beam is reduced to shift toward 90°.

By thus selecting an appropriate height a4 of the bent portion 59, scattered waves in a desired beam direction can be reduced.

According to the antenna apparatus of the fifteenth embodiment, since the bent portion 59 is provided for delaying the phases of scattered waves, adverse influences otherwise occurring around the antenna apparatus due to the scattered waves can be reduced in a desired beam direction.

Figure 32:
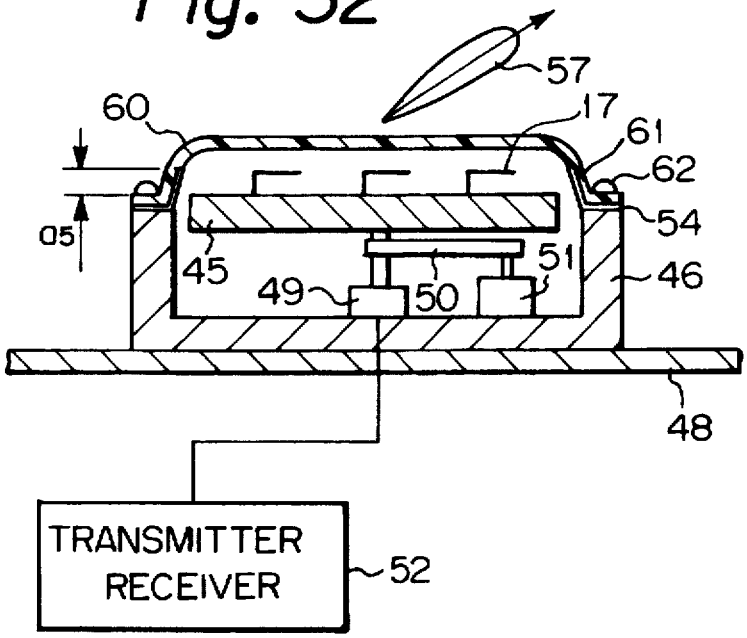
FIG. 32 is a cross-sectional view schematically showing the structure of the sixteenth embodiment of the antenna apparatus according to the present invention.

FIG. 32 shows a cross-sectional view of a sixteenth embodiment of the antenna apparatus according to the present invention. In FIG. 32, the antenna apparatus includes a radome 60 which covers the antenna apparatus; a conductive wall 61 formed by, for example, plating on the inner surface of the radome so as to be in contact with an edge portion 54 of a housing 46; and screws 62 for connecting and fixing the radome 60 to the housing 46. The remaining components are the same as those used in the thirteenth embodiment.

The basic operation of the antenna apparatus of the sixteenth embodiment is the same as the antenna apparatus of the fifteenth embodiment. The conductive wall 61 performs a similar function to the bent portion 59 in the fifteenth embodiment (FIGS. 29 and 30).

Specifically, waves radiated from short patch antennas 17 and propagating in the horizontal direction are scattered by the conductive wall 61. A change in the length a5 of the conductive wall 61 can vary a direction in which scattered waves are strong. It is therefore possible to reduce scattered waves in a desired beam direction by appropriately selecting the length a5 of the conductive wall 61.

According to the antenna apparatus of the sixteenth embodiment, since the conductive wall 61 is provided for delaying the phases of scattered waves, adverse influences otherwise occurring around the antenna apparatus due to the scattered waves can be reduced in a desired beam direction.

While in the thirteenth~sixteenth embodiments, the ground conductor plate 45 is arranged for rotation relative to the housing 46, the antenna section 45 may be fixed to the housing 46 to form an antenna apparatus in which the antenna itself does not rotate (for example, a phased array antenna).

Next, a seventeenth embodiment of the antenna apparatus according to the present invention will be described with reference to FIGS. 33 and 34.

Figure 33:
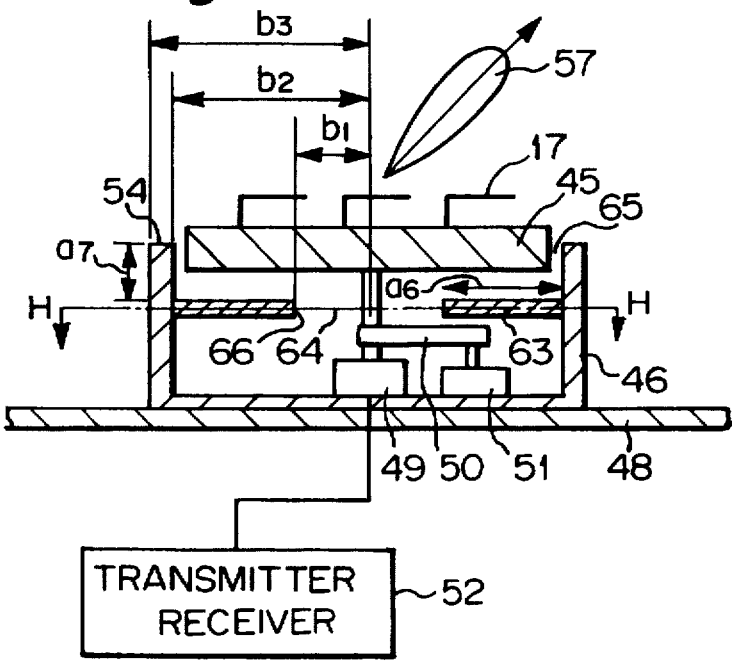
FIG. 33 is a cross-sectional view schematically showing the structure of the seventeenth embodiment of the antenna apparatus according to the present invention.
Figure 34:
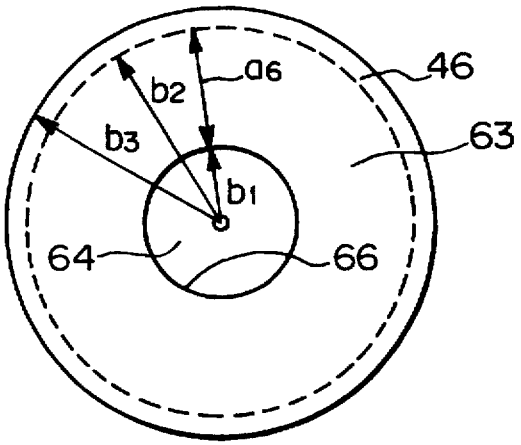
FIG. 34 is a cross-sectional view taken along an H—H line in FIG. 33.

FIG. 33 shows a cross-sectional view of the antenna apparatus according to the seventeenth embodiment, and FIG. 34 is a cross-sectional view taken along a line H—H in FIG. 33. The antenna apparatus includes a conductive donut-shaped disk positioned on the lower side of an antenna section 45 inside a housing 46. The disk 63 is formed at a central portion thereof through a hole 64 which has an edge 66. A ground conductor plate 45 is spaced from the housing 46 by a gap 65. The remaining components are the same as those used in the fourteenth embodiment.

The antenna apparatus of the seventeenth embodiment may be used in the same applications as the antenna apparatus of the thirteenth embodiment.

The operation of the antenna apparatus according to the seventeenth embodiment will be next described. Radiation of waves from a short patch antenna 17 causes a current to flow on the surface of the ground conductor plate on the upper side of the antenna section 45. However, the ground conductor plate is not electrically connected to the housing 46, and is spaced from the housing 46 by the gap 65 which is a current discontinuous section. While waves are radiated from this current discontinuous section, these waves adversely affects an antenna beam 57.

To solve this problem, the antenna apparatus of the seventeenth embodiment is provided with the donut-shaped disk 63 on the lower side of the ground conductor plate below the antenna section 45 inside the housing 46 such that the gap 65 does not form a current discontinuous section. A difference a6 between the outer diameter b2 and the inner diameter b1 of the disk 63 is a length of approximately $\lambda_0/4$ ($\lambda 0$ is a free space wavelength), where the outer periphery of the disk 63 is electrically connected to the housing 46. Thus, a waveguide is formed between the ground conductor plate below the antenna section 45 and the disk 63, while the inner edge 66 of the disk 33 is an open end of the waveguide. Viewing this waveguide from the gap 65, the waveguide constitutes an open-end stub having a length of $\lambda_0/4$, so that impedance, when viewed from the gap 65 to the disk 63, is substantially zero. In other words, the gap 65 electrically appears to be substantially short-circuited. This structure causes the discontinuity of a current in the gap 65 to disappear, and waves radiated from the gap 65 to be reduced. In this way, the influence of the radiation from the gap 65 on the antenna beam 57 is reduced.

Since the antenna apparatus of the seventeenth embodiment includes a means for electrically short-circuiting the gap 65, unnecessary scattered waves generated in the gap 65 around the antenna apparatus are decreased, thereby reducing adverse influences of the scattered waves. The radiation characteristic is thus improved in a desired beam direction.

If the distance a7 between the edge portion 54 of the housing 46 and the upper surface of the disk 63 is too large, the size of the disk 63 may be adjusted such that a length a6+a7 approximately equal to $\lambda_0/4$.

It should be noted that the donut-shaped disk 63 as in the seventeenth embodiment may also be arranged inside the housing 46 in the thirteenth~sixteenth embodiments.

As described above in connection with a variety of embodiments, since the antenna apparatus of the present invention comprises a feed circuit including a ground conductor plate, a line and a dielectric material arranged between the ground conductor plate and the line; a radiating section excited by a signal transmitted through the feed circuit; a coupling hole formed through the ground conductor plate for electromagnetically coupling the feed circuit to the radiating section; and grounding means for connecting one end of the radiating section to the ground conductor plate, the radiating section can be made in a smaller size, and accordingly the antenna apparatus can be reduced in size.

When the radiating section is spaced from the ground conductor plate by a predetermined distance, and a space is formed between the radiating section and the ground conductor plate, dielectric loss is reduced to improve the efficiency of the antenna apparatus.

When a foam dielectric material is selected as the above-mentioned dielectric material, dielectric loss is reduced to improve the efficiency of the antenna apparatus.

When the ground conductor plate is formed by plating the dielectric substrate, the number of parts and the number of assembling steps are reduced, so that the antenna apparatus can be manufactured at a lower cost.

With a holding member arranged for holding a spacing between the radiating section and the ground conductor plate, the structure of the antenna apparatus is stabilized so that the antenna apparatus presents a stable performance even if physical shock is applied thereto.

When the radiating section is arranged such that the positional relationship thereof with the coupling hole is adjustable, a coupling condition between the radiating section and the feed circuit can be easily adjusted to set the antenna apparatus to a desired performance.

When the line of the feed circuit is provided with a low impedance region or a stub for increasing a current flowing near the coupling hole so as to enhance electromagnetic coupling between the radiating section and the feed circuit, it is possible to easily establish matching between the radiating section and the feed circuit over a wider band.

When the spacing between the radiating section and the ground conductor plate is made different at a grounded end and an open end of the radiating section, it is possible to easily establish the matching between the radiating section and the feed circuit over a wider band.

With the radiating section composed of a plurality of overlapped radiating elements arranged in a predetermined spacing therebetween and placed one over the other, it is possible to easily establish the matching between the radiating section and the feed circuit over a wider band.

When the ground conductor plate is composed of a first ground plate and a second ground plate, the first ground plate is formed with the coupling hole, the line is arranged between the first ground conductor plate and the second ground conductor plate, and a connecting mechanism for connecting the first ground conductor plate to the second ground conductor plate is provided near the coupling hole, electromagnetic coupling to other lines can be reduced.

The connecting mechanism, when formed of a conductor block arranged between the first ground conductor plate and the second conductor plate for electrically shielding the feed circuit, will further reduce dielectric loss of the antenna apparatus.

When an antenna section including a feed circuit for transmitting signals, a ground conductor plate formed with at least one coupling hole, at least one radiating element electromagnetically coupled through the coupling hole and respectively excited by signals transmitted through the feed circuit, and grounding means for grounding an end of the radiating element to the ground conductor plate, is accommodated in a housing, and a tapered portion is provided for transforming the upright wall of the housing to a gentle slope to reduce scattered waves, scattered waves generated around the antenna apparatus are reduced to improve the radiation characteristic of the antenna apparatus.

Either short-circuiting means provided for short-circuiting between the ground conductor plate of the antenna section and the housing to reduce scattered waves, or a wave absorbing member arranged between the antenna section and the housing, reduces scattered waves generated around the antenna apparatus to improve the radiation characteristic of the antenna apparatus.

When propagation delay means is arranged around the antenna section for delaying the phases of waves propagated from the plurality of radiating elements to control changes in radiation patterns of the antenna section caused by scattered waves generated around the antenna, the influence of the scattered waves can be limited to a desired direction, so that the influence of the scattered waves, even if generated, can be reduced.

What is claimed is:

1. An antenna apparatus, comprising:

a dielectric substrate;

a first ground conductor plate formed on said dielectric substrate;

a radiating element of a short patch antenna type arranged over said ground conductor plate, including a signal radiating section spaced by a predetermined distance from said ground conductor plate and including connecting means for connecting one end of said signal radiating section to said ground conductor plate;

a feed circuit for exciting said radiating element;

a coupling means formed in said first ground conductor plate for electromagnetically coupling said feed circuit to said radiating element;

a second ground conductor plate in addition to and spaced apart from said first ground conductor plate, wherein said feed circuit is arranged between said first and second ground conductor plates; and a connecting mechanism for connecting said first ground conductor plate to said second ground conductor plate near said coupling means formed on said first ground conductor plate.

2. An antenna apparatus according to claim 1, wherein said dielectric substrate is a foam dielectric substrate.

3. An antenna apparatus according to claim 2, wherein said ground conductor plate is formed by plating said dielectric substrate.

4. An antenna apparatus according to claim 1, further comprising a holding member for holding a constant spacing between said signal radiating section of said radiating element and said ground conductor plate.

5. An antenna apparatus according to claim 1, wherein said radiating element is arranged such that a positional relationship thereof with a coupling hole formed on said ground conductor plate for electromagnetically coupling the feed circuit to the radiating element is adjustable.

6. An antenna apparatus according to claim 1, wherein said connecting mechanism is a conductor block arranged between said ground conductor plate and said other ground conductor plate for connecting said two ground conductor plates and for electrically shielding said feed conductor.

7. An antenna apparatus according to claim 1, wherein said feed conductor includes a low impedance portion near said coupling hole to enhance electromagnetic coupling between said radiating element and said feed circuit.

8. An antenna apparatus according to claim 1, wherein said feed conductor includes a stub near said coupling hole to enhance electromagnetic coupling between said radiating element and said feed circuit.

9. An antenna apparatus according to claim 1, wherein the spacing between said radiating element and said ground conductor plate is made different at a grounded end and an open end of said radiating element.

10. An antenna apparatus according to claim 1, wherein said radiating element includes a plurality of radiating elements having respective signal radiating sections spaced from each other by a predetermined distance.

11. An antenna apparatus as set forth in claim 1, wherein said connecting mechanism comprises a ring spacer located between said first ground conductor plate and said second ground conductor plate, and a screw inserted through said ring spacer for connecting said first ground conductor plate to said second ground conductor plate.

12. An antenna apparatus as set forth in claim 1, wherein said connecting mechanism comprises a stop nut located between said first ground conductor plate and said second ground conductor plate, said stop nut including a threaded though hole, and a screw threaded through said through hole for connecting said first ground conductor plate to said second ground conductor plate.

13. An antenna apparatus as set forth in claim 1, wherein said connecting mechanism comprises a ring spacer located between said first ground conductor plate and said second ground conductor plate, and a rivet inserted through said ring spacer for connecting said first ground conductor plate to said second ground conductor plate.

14. An antenna apparatus as set forth in claim 1, wherein said radiating element, said first ground conductor plate, and said connecting mechanism are formed by a single integrally formed structure.

15. An antenna apparatus as set forth in claim 14, wherein said single integrally formed structure is made of resin material plated with a conductive material.

16. An antenna apparatus comprising:

an antenna section including
- a feed circuit for transmitting signals;
- a ground conductor plate formed with at least one coupling hole;
- at least one radiating section excited by said feed circuit through said coupling hole; and
- grounding means for grounding an end of said radiating section to said ground conductor plate;

a housing for accommodating said antenna section; and scattered wave reducing means arranged around said housing, wherein said scattered wave reducing means is a conductor block having a tapered portion, the height of which is gradually decreased from the top end of said housing to a base portion of said housing.

17. An antenna apparatus according to claim 16, wherein said scattered wave reducing means is a wave absorbing member arranged on the top end of said housing.

18. An antenna apparatus according to claim 16, wherein said scattered wave reducing means is means for electrically short-circuiting between said housing and said ground conductor plate.

19. An antenna apparatus comprising:

an antenna section including:
- a feed circuit for transmitting signals;
- a ground conductor plate formed with at least one coupling hole;
- at least one radiating section excited by said feed circuit through said coupling hole; and
- grounding means for grounding an end of said radiating section to said ground conductor plate;
- a housing for accommodating said antenna section;
- propagation delay means for delaying the phases of waves propagated from said radiating section to control changes in radiation patterns of the antenna section caused by scattered waves generated around the antenna section.

20. An antenna apparatus comprising:

a ground conductor plate;

a radiating element of a short patch antenna type arranged on said ground conductor plate;

a feed circuit for exciting said radiating element;

a coupling means formed on said ground conductor plate for electromagnetically coupling said feed circuit to said radiating element;

said ground conductor plate being formed on one surface of a dielectric substrate;

said feed circuit being a triplate line including said ground conductor plate, another ground conductor plate and a strip conductor sandwiched between these ground conduct plates;

said ground conductor plate being formed on a dielectric substrate;

said radiating element including a signal radiating section being spaced by a predetermined distance from said ground conductor plate and connecting means for connecting one end of said signal radiating section to said ground conductor plate;

another ground conductor plate in addition to and spaced apart from said ground conductor plate, wherein a feed conductor is arranged between said two ground conductor plates; and a connecting mechanism for connecting said ground conductor plate to said another conductor plate near said coupling means formed on said ground conductor plate for electromagnetically coupling the feed circuit to the radiating element.

21. An antenna apparatus according to claim 20, including a feed conductor having a low impedance portion near said coupling means to enhance electromagnetic coupling between said radiating element and said feed circuit.

22. An antenna apparatus according to claim 20, including a feed conductor having a stub near said coupling means to enhance electromagnetic coupling between said radiating element and said feed circuit.

* * * * *

UNITED STATES PATENT AND TRADEMARK OFFICE

CERTIFICATE OF CORRECTION

PATENT NO. : 5,801,660

DATED : September 1, 1998

INVENTOR(S) : Masataka Ohtsuka et al.

It is certified that error appears in the above-indentified patent and that said Letters Patent is hereby corrected as shown below:

On the Title Page, Item [54] should read ---- ANTENNA APPARATUS USING A SHORT PATCH ANTENNA ----.
Column 1, line 1, should read ---- ANTENNA APPARATUS USING A SHORT PATCH ANTENNA ----.

Signed and Sealed this

Third Day of April, 2001

*Attest:*

Nicholas P. Godici

NICHOLAS P. GODICI

*Attesting Officer*

*Acting Director of the United States Patent and Trademark Office*